US008886085B2

(12) United States Patent
Suzuki

(10) Patent No.: US 8,886,085 B2
(45) Date of Patent: Nov. 11, 2014

(54) IMAGE FORMING APPARATUS

(71) Applicant: Canon Kabushiki Kaisha, Tokyo (JP)

(72) Inventor: Tetsuji Suzuki, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/091,900

(22) Filed: Nov. 27, 2013

(65) Prior Publication Data

US 2014/0086636 A1 Mar. 27, 2014

Related U.S. Application Data

(63) Continuation of application No. 13/150,609, filed on Jun. 1, 2011, now Pat. No. 8,626,023.

(30) Foreign Application Priority Data

Jun. 2, 2010 (JP) ..... 2010-126814

(51) Int. Cl.

| | |
|---|---|
| ***G03G 15/00*** | (2006.01) |
| ***G03G 21/16*** | (2006.01) |
| ***G03G 21/18*** | (2006.01) |
| ***G03G 15/32*** | (2006.01) |
| ***G03G 15/08*** | (2006.01) |
| ***G03G 15/04*** | (2006.01) |

(52) U.S. Cl.

CPC ..... *G03G 21/1666* (2013.01); *G03G 21/1853* (2013.01); *G03G 15/326* (2013.01); *G03G 2215/0875* (2013.01); *G03G 15/0894* (2013.01); *G03G 15/04036* (2013.01)

USPC ..... 399/110

(58) Field of Classification Search

CPC ..... G03G 21/16; G03G 21/1666

USPC ..... 399/4, 110, 125

See application file for complete search history.

(56) References Cited

U.S. PATENT DOCUMENTS

| | | | |
|---|---|---|---|
| 6,505,007 | B2 | 1/2003 | Miura et al. |
| 6,681,088 | B2 | 1/2004 | Kanno et al. |
| 6,703,094 | B2 | 3/2004 | Kakii et al. |
| 7,027,756 | B2 | 4/2006 | Hoshi et al. |

(Continued)

FOREIGN PATENT DOCUMENTS

| | | |
|---|---|---|
| JP | 2005-189254 | 7/2005 |
| JP | 2006-023340 | 1/2006 |

(Continued)

OTHER PUBLICATIONS

Machine translation of JP 2010-243958.

(Continued)

*Primary Examiner* — Walter L Lindsay, Jr.
*Assistant Examiner* — Barnabas Fekete
(74) *Attorney, Agent, or Firm* — Fitzpatrick, Cella, Harper & Scinto

(57) ABSTRACT

The image forming apparatus includes a separating member, which is provided between a light emitting device and a drum bearing portion, for supporting the light emitting device to a separated position when the cartridge is shipped while being packed together, the separating member being provided to a regulating member for regulating a supply of a developer at a shipping mode. With this structure, when the image forming apparatus is shipped while the cartridge is packed together, the light emitting device as an exposure apparatus and an electrophotographic photosensitive drum is separated from each other, whereby the reliability during the transportation while packing the cartridge together may be enhanced.

8 Claims, 14 Drawing Sheets

(56) References Cited

U.S. PATENT DOCUMENTS

| | | | |
|---|---|---|---|
| 7,072,594 | B2 | 7/2006 | Hoshi et al. |
| 7,072,603 | B2 | 7/2006 | Tsuzuki et al. |
| 7,162,174 | B2 | 1/2007 | Suzuki et al. |
| 7,162,181 | B2 | 1/2007 | Maeshima et al. |
| 7,346,293 | B2 | 3/2008 | Suzuki et al. |
| 7,664,434 | B2 | 2/2010 | Kuroda et al. |
| 7,689,146 | B2 | 3/2010 | Sato et al. |
| 7,808,520 | B2 | 10/2010 | Nakajima |
| 7,892,716 | B2 | 2/2011 | Cheong et al. |
| 2009/0297208 | A1 | 12/2009 | Suzuki et al. |
| 2010/0080618 | A1 | 4/2010 | Suzuki |
| 2011/0280621 | A1 | 11/2011 | Suzuki et al. |

FOREIGN PATENT DOCUMENTS

| | | |
|---|---|---|
| JP | 2006-113426 | 4/2006 |
| JP | 2007-072107 | 3/2007 |
| JP | 2007-298654 | 11/2007 |
| JP | 2009-023281 | 5/2009 |
| JP | 2010-243958 | 10/2010 |
| JP | 2010-201914 | 5/2011 |

OTHER PUBLICATIONS

Computer translation of Japanese Patent Pub. No. 2010-243958.

IMAGE FORMING APPARATUS

BACKGROUND OF THE INVENTION

1. Field of the Invention

The present invention relates to an electrophotographic image forming apparatus, which forms an image on a recording medium in a state in which a cartridge including at least a developer containing part adapted to contain a developer to be applied to an electrophotographic photosensitive drum, is removably mounted to a main body of the electrophotographic image forming apparatus.

2. Description of the Related Art

Herein, the electrophotographic image forming apparatus (hereinafter, referred to as image forming apparatus) is a type in which an image is formed on a recording medium by using an electrophotographic image forming process. As the image forming apparatus, for example, there are given an electrophotographic copying machine, an electrophotographic printer (for example, color LED printer), a facsimile apparatus, and a word processor. Further, as the image forming apparatus, both of a black and white type and a color type are encompassed therein. Further, the recording medium is a type on which an image is formed by the electrophotographic image forming apparatus, and includes, for example, paper and an OHP sheet.

In general, a cartridge is, for example, a process cartridge or a developing cartridge, which is removably mounted to a main body of the electrophotographic image forming apparatus to contribute to an image forming process for forming an image on the recording medium. The process cartridge is constituted as a cartridge in which at least one of charging means, developing means, and cleaning means, which serve as process means acting on an electrophotographic photosensitive drum, is formed integrally with the electrophotographic photosensitive drum, and in which the thus formed cartridge is removably mounted to the main body of the electrophotographic image forming apparatus. Therefore, the process cartridge includes one which is constructed as a cartridge in which the developing means serving as the process means is formed integrally with the electrophotographic photosensitive drum, and in which the thus formed cartridge is removably mounted to the main body of the electrophotographic image forming apparatus. Further, the process cartridge includes one which is constructed as a cartridge in which the charging means, the developing means, or the cleaning means, which serve as the process means, are formed integrally with the electrophotographic photosensitive drum, and in which the thus formed cartridge is removably mounted to the main body. The process cartridge, which includes the electrophotographic photosensitive drum and the developing means formed integrally with each other, is referred to as a so-called integral type. Besides, the process cartridge, which includes the electrophotographic photosensitive drum and the process means other than the developing means formed integrally with each other, is referred to as a so-called separate type. In the process cartridge, the user him/herself may perform mounting and removing with respect to the main body. Therefore, the user may easily perform maintenance for the main body. Further, the developing cartridge includes a developing roller, contains developer (toner) which is used for developing an electrostatic latent image formed on the electrophotographic photosensitive drum by the developing roller, and is removably mounted to the main body. In a case of the developing cartridge, the electrophotographic photosensitive drum is attached to the main body or a cartridge-support member. Alternatively, the electrophotographic photosensitive drum is provided to the so-called separate type process cartridge (in this case, the process cartridge does not include the developing means). Also in the developing cartridge, the user him/herself may perform mounting and removing with respect to the main body of the image forming apparatus. Therefore, the user may easily perform maintenance for the main body. Thus, as the cartridge, the so-called integral type or the so-called separate type process cartridge is incorporated therein. Further, there is included as the cartridge a case in which the so-called separate type process cartridge and the developing cartridge are used in a pair. Further, as the cartridge, the electrophotographic photosensitive drum is securely attached to the main body or the cartridge-support member. Then, there is included a case in which the developing cartridge is capable of acting on the electrophotographic photosensitive drum, and is removably mounted to the cartridge-support member.

In the present invention, the cartridge includes at least a developer containing part adapted to contain a developer to be applied to an electrophotographic photosensitive drum, (hereinafter, referred to as drum), and is used by being removably mounted to a main body.

In order to attain downsizing of the image forming apparatus, there are cases of using, as the exposure apparatus of the drum, light emitting devices, which are provided in line in a longitudinal direction (rotation axis direction) of the drum, and which include multiple light emitting portions that illuminate in association with image information, for exposing the photosensitive drum. As a typical example of such light emitting devices, there is given an LED head array. For example, in an LED printer, which uses the LED head array as the exposure apparatus, it is constructed such that the luminance devices expose in accordance with image information signal sent from a controller, and the exposed light beams are converged by a lens to be formed on the drum as an image. Further, Japanese Patent Application Laid-open No. 2009-23281 discloses such a construction that the distance between the lens surface and the drum surface is adjusted by the eccentric cam. In this construction, the distance between the lens surface and the drum surface may be adjusted with precision. In addition, the distance between the lens surface and the drum surface may be adjusted through only the rotation of the eccentric cam, thereby being capable of simplifying the operation for adjustment. Further, the fixation of the eccentric cam after the adjustment is carried out by an adhesive.

In the related art image forming apparatus described above, it is required to make the distance between the surface of the lens and the surface of the drum be close very much. Besides, when the cartridge was shipped while being packed together into the main body of the image forming apparatus, similarly, the distance between the surface of the lens and the surface of the drum becomes extremely closer. For that reason, if a mechanical shock is applied to the image forming apparatus during the transportation, there is such a fear that the lens and the drum may be brought into contact with each other.

In addition, in the related art image forming apparatus, through the abutment of the abutment surface provided on the drum and the outer peripheral surface of the eccentric cam, the positioning of the distance between the surface of the lens and the surface of the drum is carried out. When the image forming apparatus was shipped while the cartridge is packed together into the main body, the abutment surface of the drum and the outer peripheral surface of the eccentric cam are brought into a contact state. For that reason, when a mechanical shock is applied to the image forming apparatus during the transportation, the abutment portion for positioning is also added with the strong mechanical shock. As described above, the fixation of the eccentric cam after the adjustment is carried out by an adhesive. However, there is such a fear that the positioning by the abutment as described above may vary when the strong shock is applied to the image forming apparatus during the transportation. As a result, displacement of a focal position may cause, and there is a fear of generating an image failure thereby. Accordingly, it is conceivable to take such a countermeasure of enlarging a wrapping material so that a mechanical shock applied to the image forming apparatus during the transportation may be mitigated.

SUMMARY OF THE INVENTION

A purpose of the present invention is to provide an image forming apparatus, which is improved its transportation reliability in a state in which a cartridge is packed together by separating a light emitting device as an exposure apparatus and a drum when the image forming apparatus is shipped while the cartridge is packed together.

Another purpose of the present invention is to provide an image forming apparatus, which is improved its transportation reliability in a state in which a cartridge is packed together by separating abutment surfaces positioning a distance between a light emitting device and a drum.

A further purpose of the present invention is to provide An image forming apparatus that forms a latent image on a recording medium in a state in which cartridges each including at least a developer containing part adapted to contain a toner developer that visualizes a latent image formed on a photosensitive drum, are removably mounted to a main body of the image forming apparatus, including light emitting devices, which are provided in a rotation axis direction of the photosensitive drum, and which include multiple light emitting portions that illuminate in association with image information, for exposing the photosensitive drum, a light emitting device support member that supports the light emitting devices so that each of the light emitting devices takes an exposure position for exposing the photosensitive drum through the illumination of the multiple light emitting portions and a retracted position retracted from the exposure position, regulating members that regulate supply of the developer from the developer containing part in a packed state in which the cartridges are packed together with the main body, and a separating member, which is provided to each of the regulating members, for supporting, in the packed state, each of the light emitting devices at a separated position from the exposure position in a direction separating from the photosensitive drum, and for moving each of the light emitting devices from the separated position to the exposure position in association with a releasing operation of each of the regulating members.

Still further features of the present invention will become apparent from the following description of exemplary embodiments with reference to the attached drawings.

DESCRIPTION OF THE EMBODIMENTS

Embodiments of the present invention are described with reference to the drawings. In the embodiments described below, descriptions are made of a full-color LED printer by way of example, but are not limited thereto as long as an electrophotographic image forming apparatus employing an electric field luminescence device. In addition, in the embodiments described below, descriptions are made of a process cartridge as the cartridge by way of example, but are not limited thereto. The cartridge may be the one as long as including at least a developer containing part adapted to contain a developer to be applied to an electrophotographic photosensitive drum, and as long as being used by removably mounted to a main body of the electrophotographic image forming apparatus.

Embodiment 1

Figure 1A:
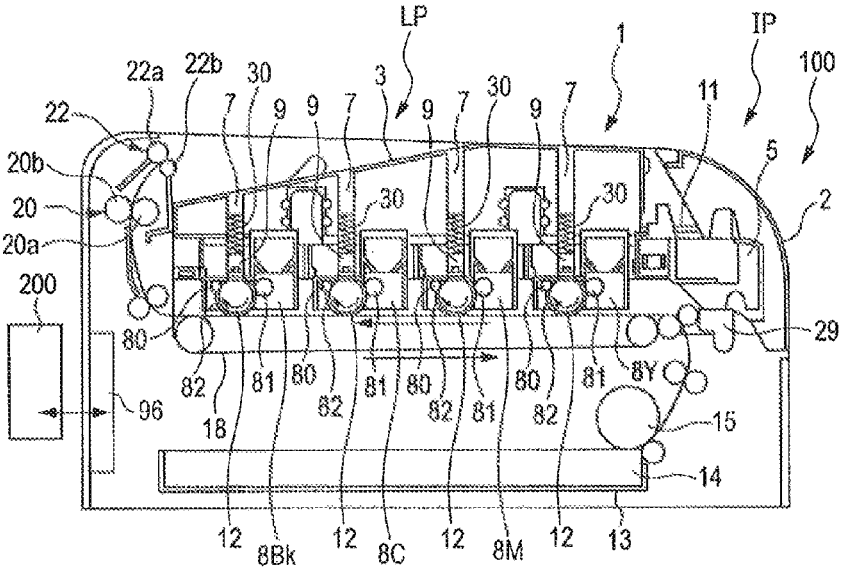
FIG. 1A illustrates a cross-section of an image forming apparatus.

FIG. 1A is a vertical sectional right side view of an electrophotographic image forming apparatus 100 of this embodiment. The apparatus 100 is an inline type color electrophotographic image forming apparatus, which forms an image on a recording medium 14 in a state in which four process cartridges 8 (8Y, 8M, 8C, and 8Bk) are removably mounted to a main body 1. As exposure apparatuses exposing electrophotographic photosensitive drums (hereinafter, referred to as drum) 12, light emitting devices 9, which expose in association with image information, are provided. For the light emitting devices 9, LED head arrays (LED type exposure apparatus) are used. More specifically, the apparatus 100 is a four full-color LED printer employing an electrophotographic process. Based on an electrical image information (image signal) to be input from the host apparatus 200 such as a personal computer and an image reader to a controller 96, color image formation is carried out on a recording medium (hereinafter, referred to as sheet) 14. Note that, in the embodiment described below, descriptions are made of a full-color LED printer by way of example, but are not limited thereto. The present invention is the one, which is applied to the above-mentioned image forming apparatus.

Figure 3A:
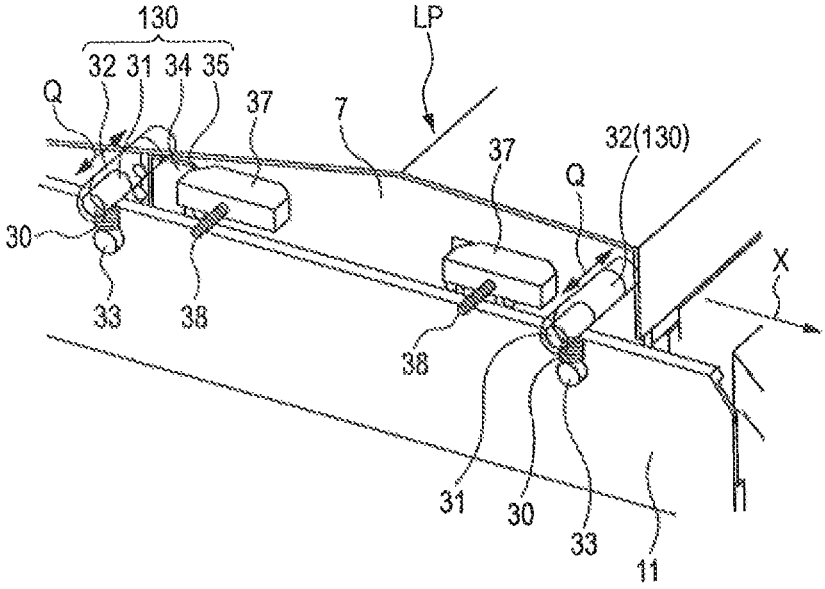
FIG. 3A and FIG. 3B each illustrate interlocking members.
Figure 3B:
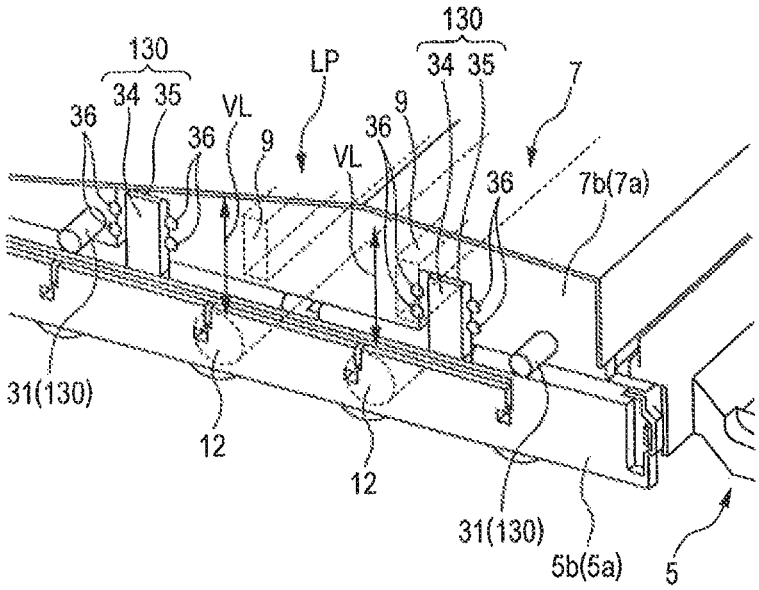

The apparatus 100 includes a tray (cartridge supporting member) 5, which moves, in a state in which the cartridges 8 are supported, between an inside position IP and an outside position OP (FIG. 4B, FIG. 5B, and FIG. 6) of the main body 1. In association with the movement of the tray 5 toward the outside position OP, a light emitting device support member 7 supporting the light emitting devices 9 are moved by interlocking members 130 (FIGS. 3A and 3B), from an exposure position LP (FIG. 4A) to a retracted position RP (FIG. 4B). Further, in association with the movement of the tray 5 toward the inside position IP, the support member 7 is moved, by the interlocking member 130, from the retracted position RP to the exposure position IP. In association with the movement of the tray 5 when the user pulled out the tray 5 toward the outside position OP, the interlocking member 130 automatically moves the support member 7 from the exposure position LP to the retracted position RP. In addition, in association with the movement of the tray 5 when the user pushes in the tray 5 toward the inside position IP, the interlocking member 130 automatically moves the support member 7 from the retracted position RP to the exposure position IP. The retracted position RP is a position at which the support member 7 (light emitting devices 9) does not interfere with the movement of the tray 5, which is supporting the cartridges 8. Besides, the retracted position RP is a position at which the support member 7 (light emitting devices 9) does not collide with the moving tray 5 and the moving cartridges 8, which are moving while being supported by the tray 5.

(Main Body of Apparatus)

Figure 1B:
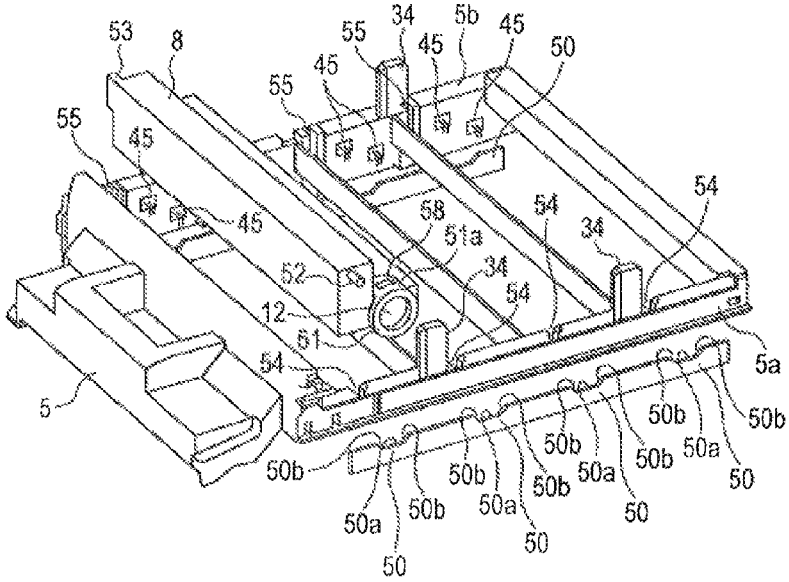
FIG. 1B is a perspective view of a tray.

The main body 1 is defined as the structure excluding the tray 5 and the cartridges 8 from the apparatus 100. In the main body 1, there are provided a sheet feeding tray 13, a feed roller 15, a transfer belt 18, a fixing device 20, sheet discharging roller pairs 22, and a delivery tray 3. The tray 13 serves to load and receive a sheet 14. The fixing device 20 includes a fixing film 20*a* and a pressure roller 20*b*. The roller pairs 22 include a sheet discharging roller 22*a* and the delivery roller 22*b*. The sheet 14, on which an image is formed, is delivered through the roller pairs 22 to be loaded on the tray 3. Further, in the main body 1, main body guide 11 are provided (refer to FIG. 3A and FIGS. 4A to 4C). The guide 11 supports the cartridge tray (cartridge support member) 5 so as to be movable. The tray 5 supports the cartridges 8 (8Y, 8M, 8C, and 8Bk) so as to be removable. In a state in which the tray 5 locates at the inside position IP inside the main body 1, the cartridges 8 are mounted to drum holders (hereinafter, refereed to as mounting portion) 50 (FIG. 1B). In the cartridges 8, drum bearing portions (positioning portion on drum side) 51 on a coaxial line with the drum 12 are positioned by the mounting portions 50.

Figure 11A:
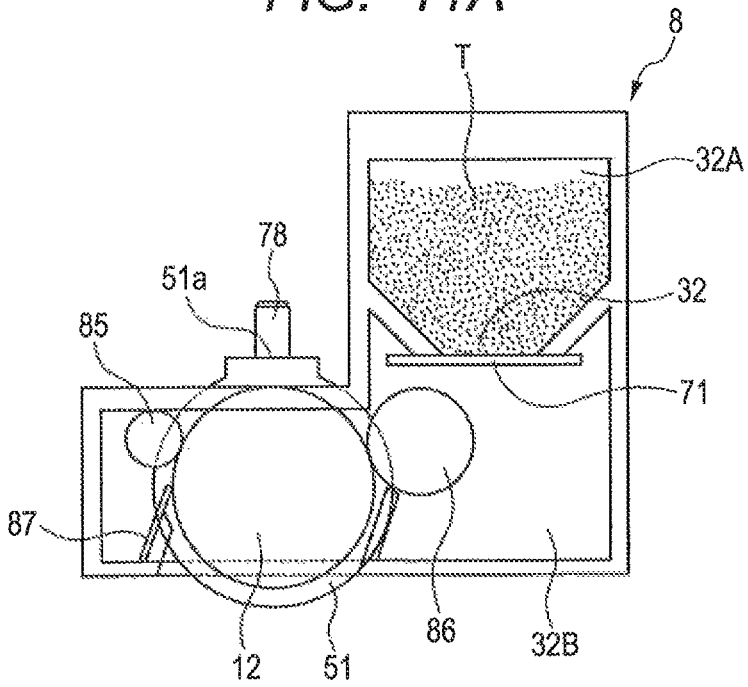
FIG. 11A is a lateral cross-sectional view of the cartridge in a state in which a seal is not yet removed.
Figure 11B:
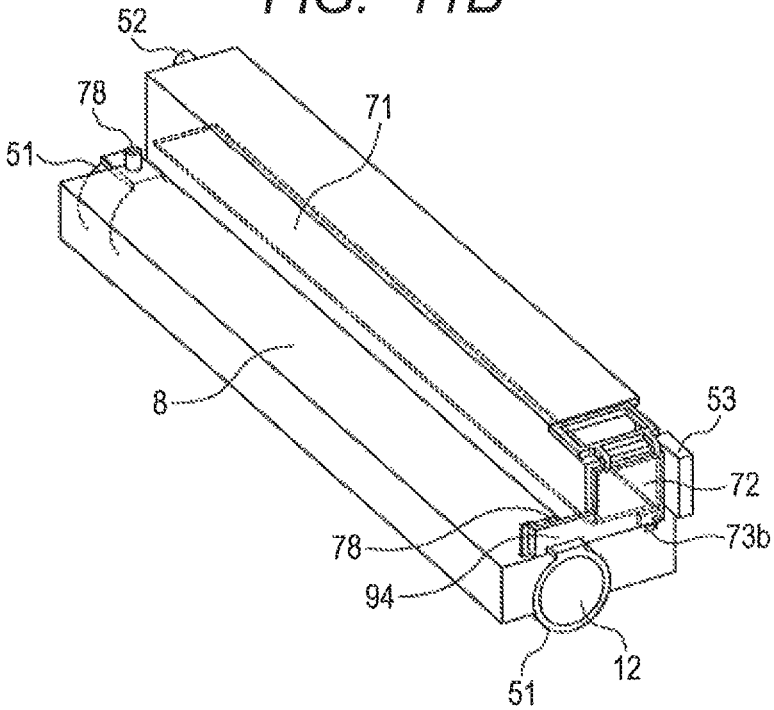
FIG. 11B is a perspective view of the cartridge in a state in which the seal is not yet removed.

The cartridge 8Y contains the yellow (Y-color) developer (hereinafter, referred to as toner), and forms a yellow developer image (toner image) on the photosensitive drum 12. The cartridge 8M contains a magenta (M-color) toner, and forms a magenta toner image on the photosensitive drum 12. The cartridge 8C contains a cyan (C-color) toner, and forms a cyan toner image on the photosensitive drum 12. The cartridge 8Bk contains a black (Bk-color) toner, and forms a black toner image on the photosensitive drum 12. The cartridges 8 each integrally include the photosensitive drum 12, and as the process means, a charging roller (charging member) 80, a developing device, and a cleaning blade (cleaning member) 82. The process means acts on the photosensitive drum 12. The charging roller 80 charges the drum 12. As illustrated in FIGS. 11A and 11B, the developing device includes a toner containing chamber (developer containing part) 32A accommodating a toner T to be applied to the drum 12, and a developing chamber (developing part) 32B having a developing roller 86 arranged therein, which serves as a developing member for developing an electrostatic latent image formed on the drum 12 by applying the toner to the drum 12. Besides, the cleaning blade 87 removes the residual developer on the drum 12 after transfer of the image. Note that, the main body (the main body of the apparatus) 1 refers to the structure omitting the cartridge tray 5 and the cartridges 8 from the image forming apparatus 100.

(Cartridge Tray)

The tray 5 is supported by the guide 11 with respect to the main body 1, and is provided so as to allow a slide movement in a lateral direction of FIG. 1A (front-back direction of main body 1). The tray 5 supports the cartridges 8 so as to be removable. Further, the tray 5 includes intermediate electrical contacts 45 (FIG. 1B) to be electrically connected to cartridge side electrical contacts (not shown) included in the cartridges 8. The intermediate electrical contacts 45 electrically connect to main body side electrical contacts (not shown) provided to the main body 1 in a state in which the tray 5 locates at the inside position IP. The intermediate electrical contact 45 is arranged on a side plate 5*b* on a non-drive side (one end portion side in longitudinal direction of cartridges 8) of the tray 5. However, the arrangement of the electrical contacts 45 is not limited thereto. The electrical contacts 45 may be arranged on the side plate 5*a* on a drive side. The tray 5 moves, in a state of removably supporting the cartridges 8, between the inside position IP inside the main body 1 and the outside position OP outside the main body 1 while passing through the opening portion 10 of the front surface of the main body 1. The guide 11 supports the tray 5 so that the tray 5 is movable between the outside position OP and the inside position IP, and also guide the tray 5. When the user pulls out the tray 5 from the main body 1, the tray 5 moves from the inside position IP to the outside position OP. Further, when the user pushes in the tray 5 into the main body 1, the tray 5 moves from the outside position OP to the inside position IP. In this case, the inside position IP refers to the positions illustrated in FIG. 1A, FIG. 4A, and FIG. 5A. Besides, the outside position OP refers to the positions illustrated in FIG. 4C, FIG. 5B, and FIG. 6. The inside position IP refers to a state in which the tray 5 locates inside the opening portion 10 of the main body 1. Besides, the outside position OP refers to a state in which the tray 5 locates outside the opening portion 10. Even in a case where the tray 5 locates at the outside position OP, all the cartridges 8 supported by the tray 5 may not locate outside the opening portion 10. For example, in a pullout direction X (FIG. 5B) of the tray 5, the cartridge 8Bk, which locates at the most upstream side, may locate inside the opening portion 10. Even in such cases, the cartridge 8Bk, which locates at the most upstream side, locates at a front forward of the main body 1, and hence it is easy for the user to replace the cartridge 8Bk from the opening portion 10. Further, the respective cartridges 8 are supported by the tray 5 in a crossing direction (orthogonal direction) of the longitudinal directions of the respective cartridges 8 with respect to the movement direction of the tray 5 (pullout direction X and push-in direction Y). The longitudinal direction is the same direction with the longitudinal direction (rotation axis direction) of the photosensitive drum 12 and the longitudinal direction of the developing roller 86. However, the present invention is applicable to a case where the respective cartridges 8 are supported by the tray 5 in a direction along which the longitudinal direction is running (parallel direction) with respect to the movement direction of the tray 5.

(Cartridge Mounting Portion)

FIG. 1A is a sectional view for illustrating a method of positioning the cartridges 8 at the mounting portions 50 in the main body 1. The mounting portions 50 are formed in the main body 1. The mounting portions 50 are arranged one end side and another end side in the longitudinal direction of the cartridges 8, which locate at the inside position (in this case, image formation positions at which cartridges 8 contribute image formation) IP in the main body 1. In each of the cartridges 8, the drum bearing portions 51 are provided. The bearing portions 51 support a drum axis (not shown) provided at the one end side and another end side in the longitudinal direction of the photosensitive drum 12 so as to be rotatable. The bearing portions 51 are provided at the one end and another end in the longitudinal direction of each of the cartridges 8 so as to project. In FIG. 1B, only one of the bearing portions 51 is illustrated. As illustrated in FIG. 1A, when the tray 5 locates at the inside position IP of the main body 1, the bearing portion 51 is supported by a recess portion 50*a* of the mounting portion 50. Specifically, the one end side bearing portion 51 is supported by the recess potion 50*a* of the one end side mounting portion 50, whereas another end side bearing portion 51 is supported by the recess portion 50*a* of another end side mounting portion 50. Owing to contacts of two slant portions 50*b* of the recess portion 50*a* and a circumferential surface 51*a* of the bearing portion 51, the positioning of a center position (axis position) of the photosensitive drum 12 with respect to the main body 1 is carried out. Further, the respective cartridges 8 are provided with a cartridge boss (first rotation-regulated member) 52 at one end of the longitudinal direction, and a cartridge rib (second rotation-regulated member) 53 at another end thereof. The tray 5 is provided with first tray groove portions (first rotation regulating members) 54 on the side plate 5*a* of one side, and second tray groove portions (second rotation regulating member) 55 on the side plate 5*b* of another side. Then, when the respective cartridges 8 are mounted into the main body 1, the bosses 52 are supported by the groove portions 54, and the ribs 53 are supported by the groove portions 55. With this structure, when the cartridge 8 receives a rotation force from the main body 1, for rotating the drum 12, the cartridge 8 is regulated so as not to rotate about the bearing portion 51 as a center. Specifically, the rotation of the cartridge 8 about the drum 12 as the center is regulated. Consequently, the positioning of the cartridge 8 with respect to the main body 1 is carried out as the drum 12 being a center.

(Light Emitting Device)

Figure 2A:
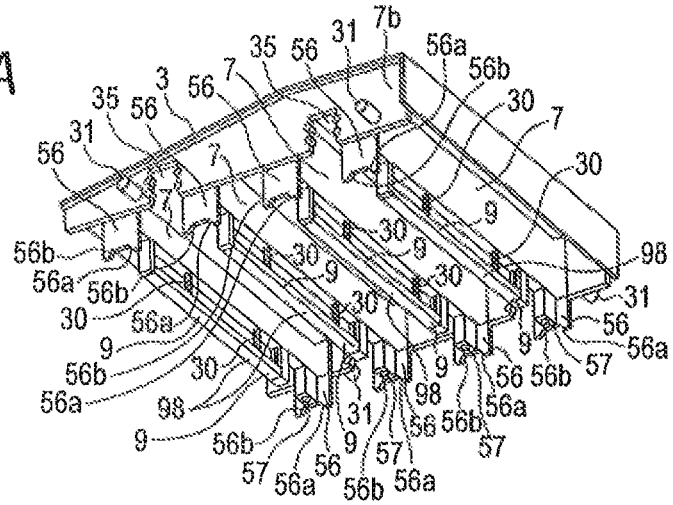
FIGS. 2A, 2B, and 2C each illustrate a support member.
Figure 8A:
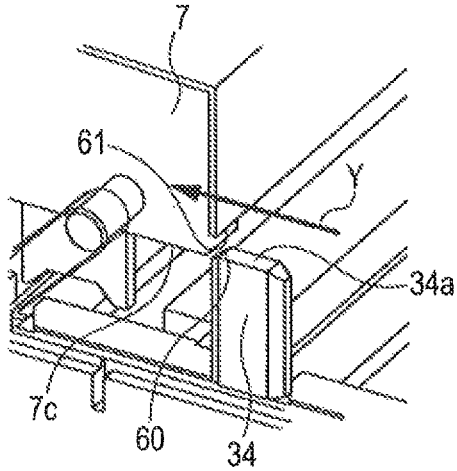
FIGS. 8A and 8B are perspective views each illustrating a projection.
Figure 8B:
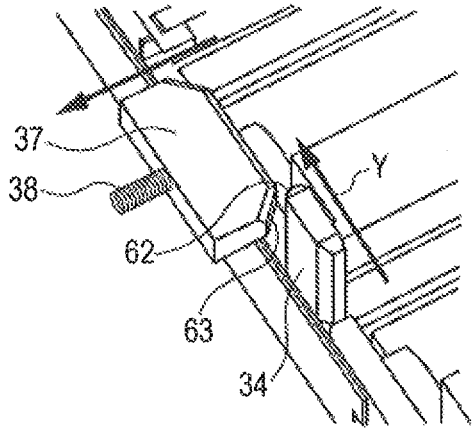
Figure 8C:
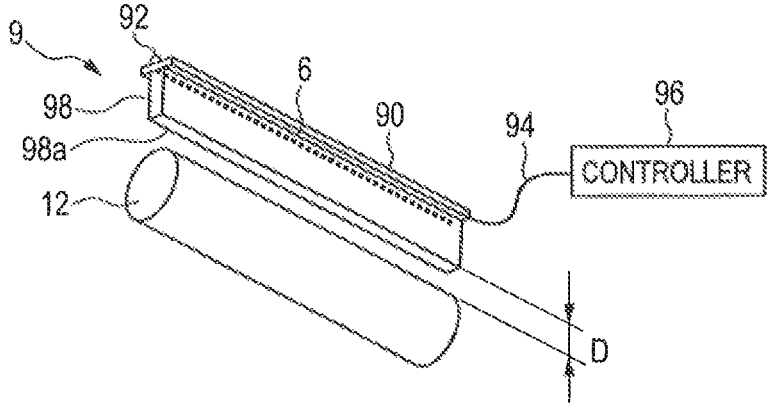
FIG. 8C is a perspective view of a light emitting device.

To the main body 1, the light emitting device support member 7 supporting the light emitting devices 9 is provided. In this embodiment, the light emitting device support member 7 is provided in the delivery tray 3. FIG. 2A is a perspective view of the support member 7. In corresponding to four cartridges 8, four light emitting devices 9 are provided to the support member 7. FIG. 8C is a perspective view of the light emitting device 9. The light emitting device 9 includes multiple light emitting portions 6, which are provided in line in the longitudinal direction (axis direction) of the drum 12 of the cartridge 8 mounted onto the main body 1. The longitudinal direction of the drum 12 is a direction orthogonal to the pullout direction X of the tray 5. The light emitting portions 6 emit light in accordance with an image information signal from a controller 96, to thereby expose the drum 12. As the light emitting portions 6, for example, electric field light emitting portions are used such as liquid crystal devices (elements), semiconductor light emitting diodes (LEDs), or organic electroluminescence devices (organic EL devices). The semiconductor light emitting diode is a semiconductor element that emits light by being applied with a voltage. The organic EL element is an electronic material made of an organic compound that illuminates by being applied with a voltage, and is a self light emitting portion. The organic EL element has, for example, a structure in which an organic light-emitting molecular layer is sandwiched by two electrodes, and a voltage is applied thereto. With this structure, an electron injected from the electrode and a hole are recombined to excite the organic molecules, and when the excited organic molecules return to a ground state, the EL element emits light. The light emitting devices 9 includes a substrate 90. The substrate 90 is supported by a holder (not shown). On the front side of the substrate 90, the light emitting portions 6 are provided, and a driver IC 92 is provided on the back side. The light emitting portions 6 are electrically connected to the driver IC 92. The driver IC 92 controls lighting operation of the light emitting portions 6. The substrate 90 is connected to the controller 96 of the main body 1 through a flexible flat cable (FFC) 94. In accordance with an image information signal from the controller 96, the driver IC 92 conducts the lighting operation of the light emitting portions 6. To each of the light emitting portions 6, a SELFOC (Registered Trademark) lens 98 is bonded. A front surface 98*a* on the drum 12 side of the lens 98 is a flat surface. The lens 98 collects the light emitted from the light emitting portions 6, to thereby conduct image formation on the drum 12. When the support member 7 locates at the exposure position LP (FIG. 1A), the support member 7 supports the light emitting devices 9 so that the light emitting portions 6 face an image formation region in the longitudinal direction of the drum 12 (FIG. 3A). The exposure position LP is a position at which the drum 12 is exposed through the light emission of the light emitting portions 6, which being a position at which the multiple light emitting portions 6 are provided in line along the longitudinal direction of the drum 12. In this embodiment, in a state in which the support member 7 locates at the exposure position LP, each of the multiple light emitting portions 6 and the drum 12 are positioned at equal intervals.

In this embodiment, each of the multiple light emitting portions 6 and the drum 12 are positioned at the equal intervals at the exposure position LP, but the present invention is not limited thereto. For example, in a case where the sizes of the lenses 98 corresponding to the respective multiple light emitting portions 6 differ from each other, the distances between the multiple light emitting portions 6 and the drum 12 differ. The distance between each of the multiple light emitting portions 6 and the drum 12 is set to so that the light emitted from the light emitting portions 6 is collected by the lens 98 to form an image on the drum 12. Accordingly, depending on specifications of the lens 98, the multiple light emitting portions 6 may be arranged in curve so that the distance between the light emitting portions 6 and the drum 12 becomes shorter at the both end portions in the axis direction of the drum 12, and becomes longer at the center portion in the axis direction. Alternatively, the multiple light emitting portions 6 may be arranged in curve so that the distance between the light emitting portions 6 and the drum 12 becomes longer at the both end portions in the axis direction of the drum 12, and becomes shorter at the center portion in the axis direction. Besides, the support member is provided inside the tray 3, and hence the support member 7 is moved integrally with the tray 3. In this case, the inside of the tray 3 refers to a lower surface of the tray 3, which being the inside of the main body 1.

(Positioning Members)

Provided to the support member 7 are, as the positioning members, drum receiving portions (first regulating portions; front-back regulating portions) 56 and thrust bosses (second regulating portions; right-left regulating portions) 57. The drum receiving portions 56 are provided at the corresponding positions on one end side and another end side, respectively, in the longitudinal direction of the cartridges 8. The thrust bosses 57 are provided on one end side in the longitudinal direction of the cartridges 8. The receiving portions 56 and the bosses 57 perform the positioning of the cartridges 8, which are mounted to the image formation positions within an allowable limit error, with respect to the light emitting devices 9. Note that, the image formation position refers to positions at which the cartridges 8 supported by the tray 5 are mounted to the mounting portions 50 in the main body 1, and the drums 12 are brought into contact with a transfer belt 18. The receiving portions 56 and the bosses 57 perform the positioning of the cartridges 8 with respect to the light emitting devices 9, when the support member 7 locates at the exposure position LP in a state in which the cartridges 8 are mounted to the mounting portions 50.

Figure 2B:
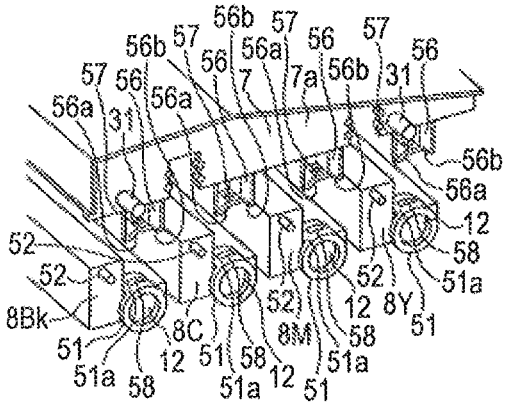
Figure 2C:
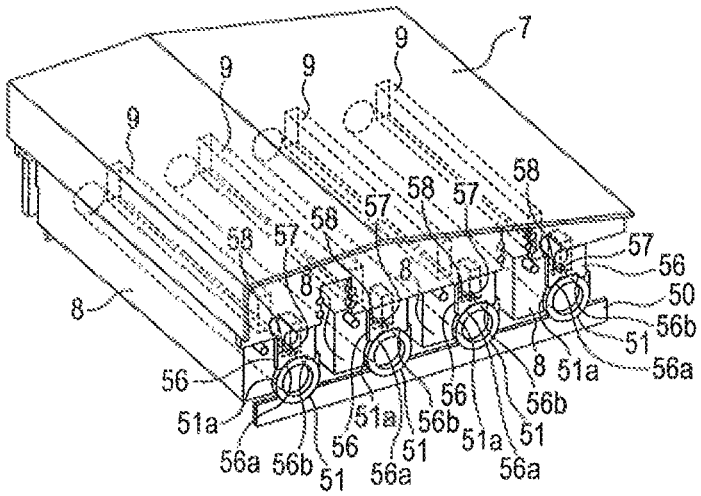

FIG. 2B is a perspective view for illustrating a method of positioning the drums 12 of the cartridges 8 with respect to the light emitting devices 9. The positioning of the light emitting devices 9 with respect to an orthogonal direction (front-back direction) to the axis direction of the drums 12 (longitudinal direction) is performed by supporting the receiving portions 56 as the positioning portions on the light emitting portions by the bearing portions 51 as the positioning portion on the drum side. The receiving portions 56 and the two slant surfaces 56*a*, 56*b* are brought into contact with the circumferential surface 51*a* of the bearing portions 51. With this structure, the positioning of the light emitting devices 9 with respect to the drum 12 is performed in a front-back direction. Further, the positioning of the light emitting devices 9 with respect to the longitudinal direction (right-left direction) of the drum 12 is performed by inserting the bosses 57 into the cartridge groove portions 58 formed in the cartridges 8. In this embodiment, the groove portions 58 are formed on one end side of the bearing portions 51. The groove portions 58 are formed to be long in the front-back direction so that the groove portions 58 inserted into the bosses 57 are movable in the front-back direction. However, to positioning the light emitting devices 9 with respect to the drum 12 in a right-left direction, the bosses 57 are engaged tightly with respect to the groove portions 58 in the right-left direction. The bosses 57 inserted into the groove portions 58 do not move in the right-left direction. Besides, the positioning of the light emitting devices 9 with respect to the vertical direction of the drum 12 is performed by supporting the receiving portions (light emitting portion side positioning portions) 56 by the bearing portions (drum side positioning portion) 51. This is the same as the positioning in the front-back direction. The distance D between the surface of the drum 12 and the lens surface 98*a* of the light emitting devices 9 is maintained to a predetermined distance through the contact between the two slant surfaces 56*a* and 56*b* of the receiving portions 56 and the circumferential surface 51*a* of the bearing portions 51. FIG. 2C is a perspective view illustrating a state in which the positioning of the light emitting devices 9 to the cartridges 8 is performed. FIG. 2C illustrates only the one end side bearing portions 51, and another end side bearing portions 51 are omitted for explanation.

In this case, a forward side or a front surface side with respect to the main body 1 refers to a side to which a door (openable and closable member) 2 is arranged. A back side is an opposite side thereto. A direction which is orthogonal to the longitudinal direction of the drum 12 (in front-back direction) is a direction, which is directed from the back side to the front side of the main body 1 (forward direction) and its reverse direction (backward direction). The right-left refers to the right or left when viewed from the front side of the main body 1. The axis direction (longitudinal direction); (right-left direction) of the photosensitive drum 12 refers to a direction which is directed from the right to the left (left direction) and its reverse direction (right direction). Note that, the door 2 may take a closing position for blocking the opening portion 10 and an opening position for opening the opening portion 10. As described above, in this embodiment, in a state in which the one end side bearing portions 51 are supported by the one end side mounting portions 50, and further another end side bearing portions 51 are supported by another end side mounting portions 50, the positioning of the light emitting devices 9 with respect to the drum 12 is performed. In this case, in order that the light emitting devices 9 be positioned at equal intervals with the drum 12 over the longitudinal direction of the drum 12, the one end side receiving portions 56 are supported by the one end side bearing portions 51, and further another end side receiving portions 56 are supported by another end side bearing portions 51.

Further, FIG. 3A is a perspective view for illustrating a method of urging the light emitting devices 9 to the drum 12. The projection portions 31 are provided to the support member 7. Further, the guide 11 for supporting the tray 5 is provided with rail bosses 33. Further, between the projection portions 31 and the bosses 33, extension springs (elastic members) 30 are attached. The springs 30 urge the support member 7 to the exposure position LP. With this urging force (elastic force), the positions of the light emitting devices 9 with respect to the photosensitive drum 12 in an up-down direction (vertical direction) are regulated. The support member 7 adjacently arranges the light emitting devices 9 to the drum 12 so as to face with the drum 12 at the exposure position LP. The distance D between the surface of the drum 12 and the surface 98*a* of the SELFOC (Registered Trademark) lens 98 of the light emitting devices 9 is regulated to a predetermined distance at the exposure position LP. The predetermined distance is a distance, which is suited to the exposure of the drum 12. In this embodiment, the predetermined distance falls within a range of 2 mm or more and 3 mm or less. According to this embodiment, if the distance falls within the numerical values, owing to luminescence of the light emitting portions 6 in accordance with image information, the drum is satisfactory exposed. In this embodiment, the distance between the surface of the drum 12 and the light emitting portions 6 including the lens 98 is 7 mm or more and 8 mm or less. However, if the specifications of the lens 98 are changed, the above-mentioned predetermined distance is changed because a lens thickness and a focal depth are varied. For example, the distance between the surface of the drum 12 and the light emitting portions 6 including the lens 98 may be set to 17 mm±0.8 mm, 10 mm±0.5 mm, 5 mm±0.3 mm, 4 mm±0.3 mm, and the like in accordance with the specifications of the lens 98. The distance D between the surface of the drum 12 and the lens surface 98*a* of the light emitting devices 9 is maintained to the predetermined distance through the contact of the two slant surfaces 56*a*, 56*b* of the receiving portions 56 and the circumferential surface 51*a* of the drum bearing portions 51 (FIG. 2C).

(Description of Image Formation Operation)

At the time of image formation, the drums 12 rotate clockwise as illustrated by arrows (FIG. 1A). The surfaces of the drums 12 are uniformly charged by the charging rollers (charging members) 80. The light emitting portions 6 emit light in accordance with an image information signal from the controller 96, and expose the charged surfaces of the drums 12, to thereby form an electrostatic latent image. The electrostatic latent image formed by the drums 12 is developed by the developers with the developing rollers (developing members) 81, and becomes the developer image. The sheet 14, which is fed from the tray 13 by the roller 15 is transported to the transfer belt 18 in synchronism with timing of the developer image. The transfer belt 18 rotates counter clockwise, while electrically sucking the sheet 14 (arrow direction of FIG. 1A). The sheets 14 are transported by the transfer belt 18, and pass one after another a transfer portion between the transfer belt 18 and the drums included in the cartridges 8Y, 8M, 8C, and 8Bk. With this operation, a yellow developer image, a magenta developer image, a cyan developer image, and a black developer image are transferred one after another superimposingly onto the sheet 14. After the transfer, the developers remained on the drums 12 are removed by the cleaning blades 82. The sheet 14 is transported to a nip portion between the fixing film 20*a* and the pressure roller 20*b* of the fixing device 20. The toner image formed on the sheet 14 is heated and pressed at the nip portion and is fixed onto the sheet 14. The sheet 14 having an image formed thereon is delivered onto the tray 3 by the roller pairs 22*a*, 22*b*. Note that, from the figures other than FIG. 1A, illustrations of the charging roller 80, the developing roller 86, and the cleaning blade 87 are omitted.

(Description of Cartridge Replacement Method)

Figure 4A:
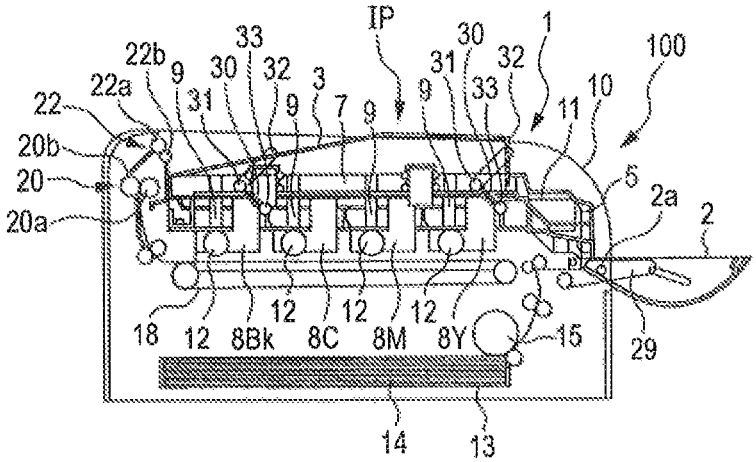
FIGS. 4A, 4B, and 4C are diagrams for illustrating replacements of cartridges.
Figure 4B:
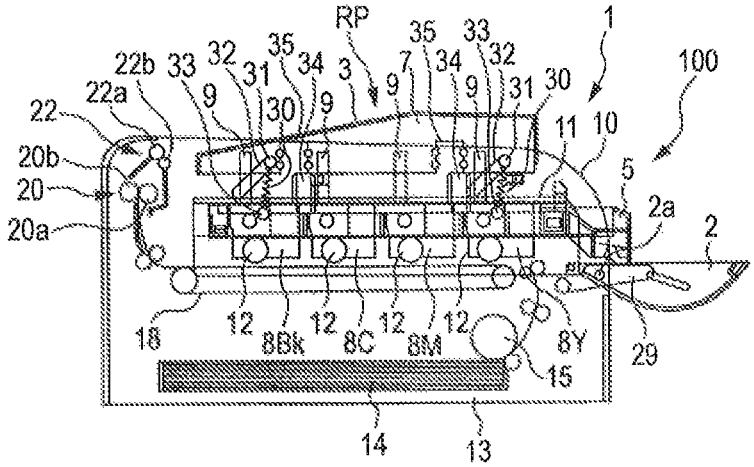
Figure 4C:
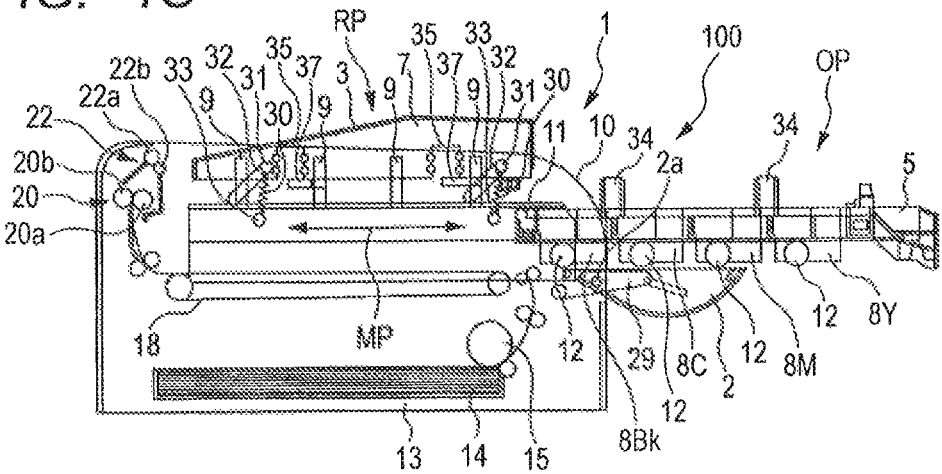
Figure 5A:
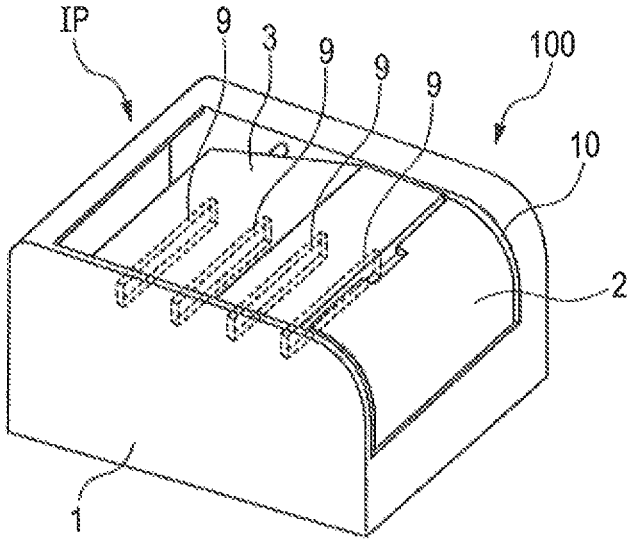
FIG. 5A is a perspective view illustrating the image forming apparatus in a door closed state.
Figure 5B:
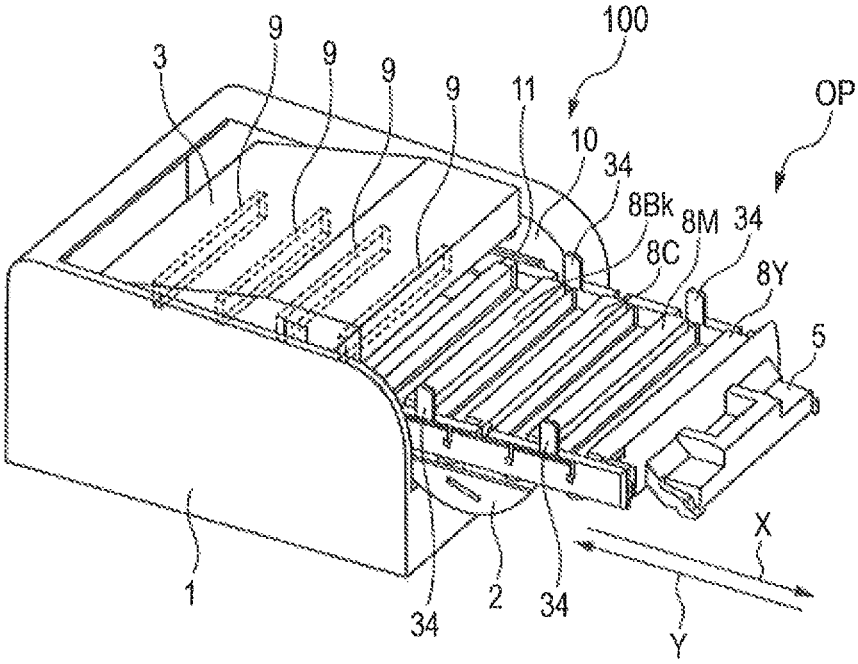
FIG. 5B is a perspective view of the image forming apparatus in a state in which the door is opened and the tray is pulled out to an outside position.
Figure 6:
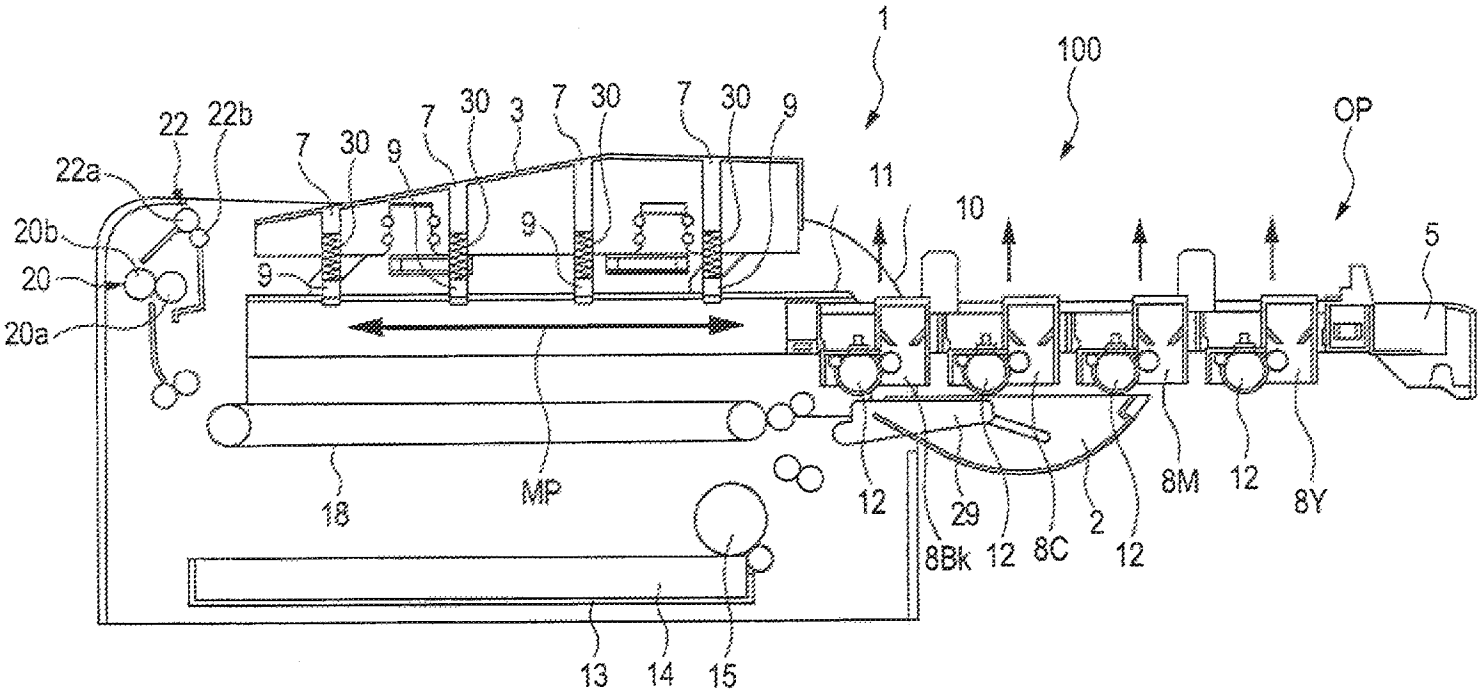
FIG. 6 is a sectional view of the image forming apparatus in a state in which the door is opened and the tray is pulled out to the outside position.

FIGS. 4A to 4C are sectional views of the image forming apparatus for illustrating a cartridge replacement method. FIG. 5A is a perspective view of the main body 1 in which the door (openable and closable member) 2 is closed. The door 2 is rotatably provided with respect to the main body 1 for opening and closing the opening portion 10 of the main body 1. The door 2 takes a closing position for closing the opening portion 10 and an opening position for opening the opening portion 10 through the rotation about a hinge 2*a* as a center. The user opens the door 2 to open the opening portion 10, and performs operations such as the replacement of the cartridges 8. FIG. 4A is a sectional view of the image forming apparatus in which the door 2 is opened. The tray 5 is supported with respect to the main body 1 by the guide 11, and is slidingly movable in a lateral direction of FIG. 4A (front-back direction). The tray 5 supports the cartridges 8 so as to be removable. The tray 5 is movable between the outside position OP and the inside position for positioning the cartridges 8 to the mounting portions 50 in the main body 1 while passing through the opening portion 10 of the main body 1. In this case, the outside position OP refers to a position outside the main body 1, and at which the user mounts and removes the cartridges 8 to the tray 5. Further, the inside positions IP refers to the positions for positioning the cartridges 8 to the mounting portions 50 in the main body 1. In this embodiment, the cartridges 8 locating at the inside position IP locate at the image formation positions (IP). The image formation positions (IP) refer to the positions at which the cartridges 8 contribute to form an image on the sheet 14. The tray 5 moves by the user between the inside position IP and the outside position OP while passing through the opening portion 10. The door 2 engages to the guide 11 via a door link 29. If the user opens the door 2, in association with the opening operation of the door 2, the link 29 pulls out the guide 11 from a position illustrated in FIG. 1 to a position illustrated in FIG. 5A. Simultaneously, the link 29 moves the guide 11 obliquely upward on the right side. Owing to the upward movement of the guide 11, the tray 5 supported by the guide 11 moves upward. Owing to the upward movement of the tray 5, the drum 12 is spaced apart from the transfer belt 18. Further, the bearing portions 51 are spaced apart from the mounting portions 50. FIG. 4B is a view illustrating a state in which the door 2 is opened, and the tray 5 in the main body is pulled out, whereby the support member 7 is moved upward to the retracted position RP. The support member 7 is automatically moved, in association with the movement of the tray 5 at the time when the user pulls out the tray 5, from the exposure position LP to the retracted position RP by the interlocking member (described later). The retracted position RP is a position retracted from the exposure position LP. The retracted position RP is a position at which the support member 7 (light emitting devices 9) does not interfere with the movement of the tray 5, which is supporting the cartridges 8. Besides, the retracted position RP is a position at which the support member 7 (light emitting devices 9) does not collide with the moving tray 5 and the moving cartridges 8, which are moving while being supported by the tray 5. The support member 7 is retracted from a moving path MP (FIG. 4C) in which the tray 5 moves between the outside position OP and the inside position IP. As the support member 7 moves to the retracted position RP, the multiple light emitting devices 9 may be simultaneously retracted. When the support member 7 locates at the retracted positions RP, the light emitting devices 9 exist within the main body 1. At the retracted position RP, the support member 7 allows the movement of the tray 5 between the outside position OP and the inside position IP. Specifically, the support member 7 does not interfere with the movement of the tray 5. With this, while leaving the support member 7 in the main body 1, the tray 5 may be pulled out from the main body 1. FIG. 4C is a view illustrating the tray 5, which is pulled out from the inside position IP to the outside position OP. When the tray 5 locates at the outside position OP, the upward of all the cartridges 8 supported by the tray 5 is opened. Then, the respective cartridges 8 may be removed upward (arrows of FIG. 6). Further, all the cartridges 8 may be supported from the upward by the tray 5. Specifically, the mounting and removing of the cartridges 8 with respect to the tray 5 may be performed from a vertical direction. Note that, according to this embodiment, when the cartridge 8Bk, which locates most downstream in the pullout direction X (FIG. 3A), is mounted and removed with respect to the tray 5, the entire length of the tray 5 may not locate at the outside position OP. Even in such cases, the tray 5 is pulled out toward the outside direction than a case where the cartridge 8Bk locates at the image formation position (IP). Consequently, the cartridge 8Bk is pulled out more, than in a case of locating at the image formation position, at a front forward of the main body 1, it is easy for the user to replace the cartridge 8Bk. FIG. 5B is a perspective view of the main body 1 in a state in which the door 2 is opened and the tray 5 is pulled out. FIG. 5B illustrates the same state illustrated in FIG. 4C and FIG. 6. In this state, the cartridges 8 are removable to the tray 5. The tray 5 moves in a horizontal direction with respect to an installation surface of the main body 1 (not shown). However, in this embodiment, it is not limited to this, and the tray 5 may move, for example, obliquely upward with respect to the installation surface (not shown), or linearly and obliquely downward. The tray 5 moves linearly in a direction orthogonal to the longitudinal direction of the cartridges 8 supported by the tray 5 (accommodated, mounted). The longitudinal direction of the cartridges 8 refers to the longitudinal direction of the photosensitive drum 12, or the longitudinal direction of the developing roller 86.

Operation of mounting the cartridges 8 to the main body 1 is performed by the reverse procedure with the operation of removing the cartridges 8. Specifically, the user pulls out the tray 5 to the outside position OP, and the cartridges 8 is mounted on the tray 5 (supported). The tray 5 having mounted the cartridges 8 thereon is pushed in the main body 1. In this case, the support member 7 automatically moves, in association with the movement of the tray 5 when the user pushes in the tray 5, from the retracted position RP to the exposure position LP by the interlocking member 130 described later. The exposure position LP locates at an adjacent position to the drum so that the light emitting devices 9 face the drums 12, and are enabled to expose the drum 12 in accordance with an image information. Then, in association with the closing operation of the door 2 performed by the user, the guide 11 is pushed down to left downward from the position illustrated in FIG. 4A via the link 29. The tray 5 moves downward together with the guide 11. With this operation, the cartridges 8 supported by the tray 5 are mounted to the mounting portions 50 in the main body 1. Then, the drum 12 is brought into contact with the transfer belt 18. This state is a state in which the cartridges 8 locate at the image formation positions (FIG. 1A). The image formation positions are positions at which the cartridges 8 contribute to form an image on the sheet (recording medium) 14.

(Description of Retraction Method of Light emitting device support)

1) Structure of Interlocking Member

The image forming apparatus according to Embodiment 1 of the present invention includes an interlocking member 130, which moves, in association with the pull-out or push-in operation of the tray 5 performed by the user, the support member 7 between the exposure position LP and the retracted position RP. In this case, in order to expose the drums 12 by the luminescence of the multiple light emitting portions 6 of the light emitting devices 9 at the exposure position LP, the light emitting devices 9 are arranged adjacently to the drums 12 so as face thereto. The multiple light emitting portions 6 are arranged in line in the longitudinal direction of the light emitting devices 9. At the retracted position RP, the support member 7 is retracted from the moving path MP in which the tray 5 moves between the outside position OP and the inside position IP. FIGS. 3A and 3B illustrate positional relations, under the door 2 closing state, among the support member 7, the guide 11, and the tray 5. Each of the interlocking members 130 includes an engagement projection portion (first engage portion) 34, an engagement groove portion (second engage portion) 35, a projection portion (third engage portion) 31, and a groove portion (fourth engage portion) 32. The projection portion 34 is provided to the tray 5. The engagement groove portion 35 is formed in the support member 7. The projection portion (third engage portion) 31 is provided to the support member 7. The groove portion 32 is formed in the main body 1. The projection portion 34 is a substantially rectangular member extending from the side plate 5*b* (5*a*) upwardly. The groove portion 35 is a generally substantially rectangular groove hole formed in a side plate 7*b* (7*a*) and extending vertical direction of the support member 7. The projection portion 34 engages with the groove portion 35 so as to be slidable in the groove portion 35. The groove portion 35 engages with the projection portion 34, and supports the support member 7 with respect to the tray 5 so as to be movable along a straight line direction connecting the light emitting device 9 and the center of the drum 12. In this case, the straight line direction connecting the light emitting portions 6 and the center of the drum 12 is a direction represented by arrows VL (FIG. 3B). Specifically, the light emitting devices 9 move in parallel and linearly to the axis line of the drum 12. With this structure, compared to a case in which the light emitting device 9 is rotated about a fulcrum as a center, according to this embodiment, even if the space is smaller, the light emitting devices 9 (light emitting portions 6) may be moved between the exposure position LP and the retracted position RP. The projection portions 31 are inserted into the groove portions 32, and are slidingly movable within the groove portions 32. The projection portions 31 slide within the groove portions 32. With this operation, the support member 7 is movable with respect to the main body 1, as illustrated in FIG. 3A, in an oblique direction Q with respect to the pullout direction X. Specifically, through the engagement of the projection portions 31 and the groove portions 32, the support member 7 is caused to move linearly with respect to the movement direction of the tray (pullout direction X and push-in direction Y) with respect to the main body 1 along the oblique direction Q. In a state in which the door 2 is closed (illustrated in FIGS. 3A and 3B), the extension springs (elastic member, urging member) 30 are coupled between the rail bosses 33 provided to the projection portions 31 and the guide 11. In the support member 7, the light emitting devices 9 are urged (pulled) to the exposure position LP by the elastic force of the spring 30.

2) Function of Interlocking Member

Figure 7A:
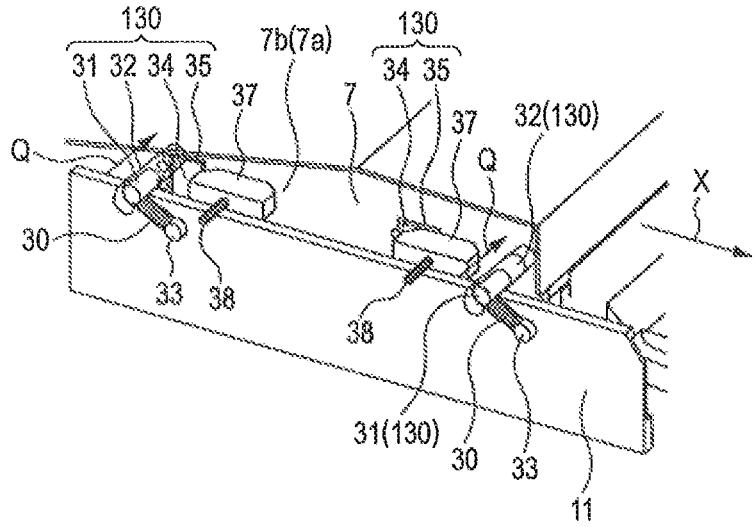
FIGS. 7A, 7B, and 7C are perspective views each illustrating the interlocking members.
Figure 7B:
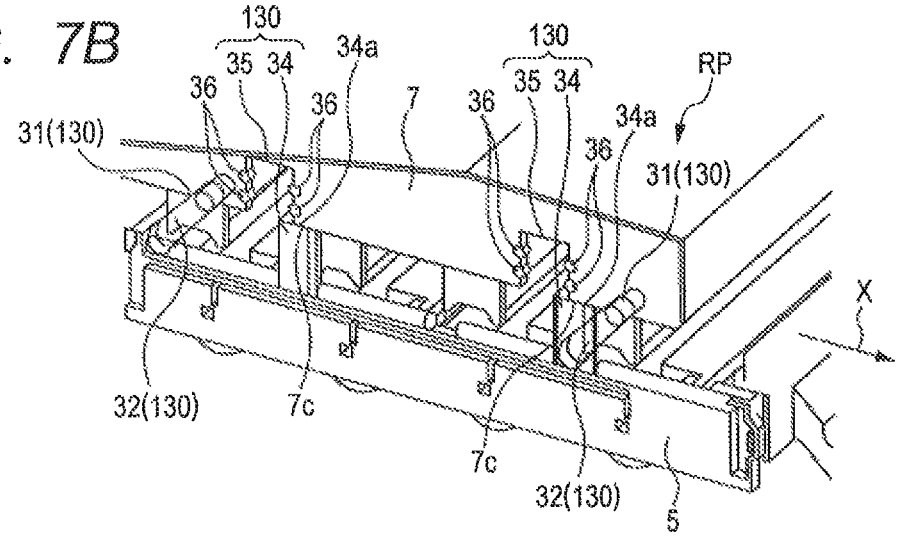

FIG. 7A illustrates a state in which the door 2 (openable and closable member) is opened, and is the same state as illustrated in FIG. 4A. As illustrated in FIG. 7A, if the door 2 is opened, in association with the movement of the guide 11 to upward, the tray 5 moves upward. With this operation, the support member 7 also moves upward. In this state, if the user pulls out the tray 5, the support member 7 is pulled out in the pullout direction X through the engagement of the projection portions 34 of the tray 5 and the groove portions 35 of the support member 7. In this case, the support member 7 is regulated so as to movable in a direction only indicated by arrows Q (FIG. 7A) with respect to the main body 1, through the engagement of the projection portions 31 and the groove portions 32. Therefore, the support member 7 is moved linearly in the direction indicated by the arrows Q with respect to the main body 1 (obliquely upward with respect to pullout direction X of tray 5). Further, the support member 7 is regulated so as to be movable linearly and upward of a vertical direction only with respect to the tray 5 by the projection portions 34 and the groove portions 35 (direction indicated by arrows VL of FIG. 3B). With this structure, the light emitting devices 9 are retracted linearly upward in the vertical direction (direction indicated by arrows VL) with respect to the drums 12 of the cartridges 8. The support member 7 moves linearly from the exposure position LP to the retracted position RP. Besides, each of the groove portions 35 are provided with rotatable roller members (friction reducing members) 36. When the tray 5 moves, a part of the tray 5 is brought into contact with the roller members 36 so that the roller members 36 rotate. With this rotation, friction between the projection portions 34 and the groove portions 35 is reduced. Owing to this, the support member 7 smoothly moves in the up-down direction with respect to the tray 5. FIG. 7B illustrates a state in which the support member 7 is moved up to the retracted position RP, and is the same state as illustrated in FIG. 4B. The retracted position RP locates at the downstream and upward of the exposure position LP in the pullout direction X in which the tray 5 moves from the inside position IP to the outside position OP. In this state, tops 34*a* of the projection portions 34 support the bottom portion 7*c* of the support member 7. With this structure, the support member 7 is regulated by the springs 30 so as not to return from the retracted position RP to the exposure position LP.

Figure 7C:
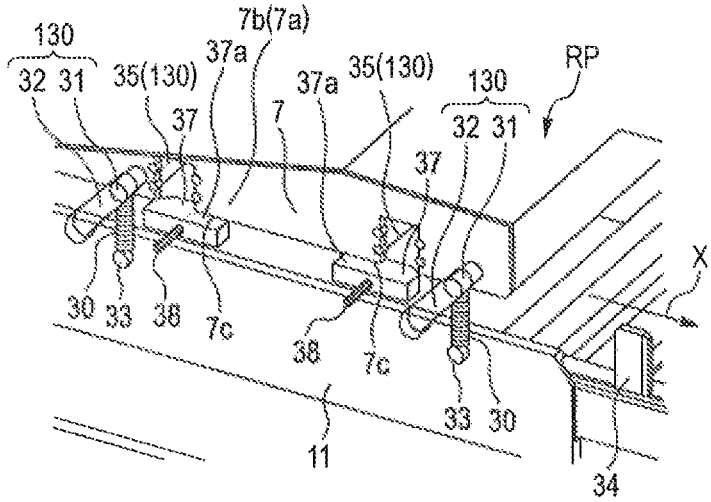

Supporting bosses 37 are provided to the main body 1 for retaining (supporting) the support member 7 at the retracted position RP. The bosses 37 are urged (pulled) toward the inside of the main body by elastic forces of boss springs (elastic members) 38. When the support member 7 locates at the exposure position LP, the bosses 37 are urged by the elastic force of the boss springs 38 so as to abut against the side plate 7*b* of the support member 7. Heights of upper surfaces 37*a* of the bosses 37 are set so as to be lower than the heights of the tops 34*a* of the projection portions 34. Thus, if the bottom portion 7*c* of the support member 7 is supported by the tops 34*a* of the projection portions 34, the support member 7 is delivered to the bosses 37 from the projection portions 34. Specifically, when the tray 5 is pulled out from a state illustrated in FIG. 7B toward the pullout direction X, as illustrated in FIG. 7C, the support member 7 is supported (retained) by the bosses 37 at the retracted position RP. Further, in a state illustrated in FIG. 7B, the bosses 37 are regulated by the projection portions 34 their movements toward the inside of the main body. This is to prevent the movement of the support member 7 from being obstructed by the bosses 37 being caught by the groove portions 35. Further, when the tray 5 is pulled out further from a state illustrated in FIG. 7B toward the pullout direction X, the engagement between the bosses 37 and the projection portions 34 is released. The bosses 37 protrude by the elastic forces of the springs 38 toward the inside of the main body, to thereby support (retain) the support member 7 at the retracted position RP. With this structure, the support member 7 retracts from the movement path MP in which the tray 5 moves between the outside position OP and the inside position IP. Consequently, the tray 5 becomes possible to move to the outside position OP.

When mounting the cartridges 8 onto the main body 1, the user pushes in the tray 5 toward a push-in direction Y, which is an opposite direction to the pullout direction X. In association with the push-in operation, first, the support member 7, which locates at the retracted position RP, is delivered from the upper surfaces 37*a* of the bosses 37 to the tops 34*a* of the projection portions 34. In this case, the bottom portion 7*c* of the support member 7 before the delivery is lower than the tops 34*a* of the projection portions 34. Therefore, the bottom portion 7*c* of the support member 7 is required to be elevated to the height of the tops 34*a* of the projection portions 34. As illustrated in FIG. 7A, first slant surfaces 60 are provided on the projection portions 34. Further, provided to the support member 7 is a support slant surface 61. When the tray 5 pushes in toward the push-in direction (mounting direction) Y, the first slant surfaces 60 and the support slant surface 61 are engaged with each other. With this engagement, the support member 7 is raised. The support member 7 is raised by a height difference between the top surfaces 37 of the bosses 37 and the tops 34*a* of the projection portions 34. Thus, the support member 7 is delivered from the bosses 37 to the projection portions 34. Further, as illustrated in FIG. 7B, the projection portions are provided with second slant surfaces 62, and the support bosses 37 are provided with boss slant surfaces 63. When the tray 5 is pushes in further from a state illustrated in FIG. 7B toward the push-in direction Y, the second slant surfaces 62 and the boss slant surfaces 63 are engaged with each other. With this engagement, the bosses 37 are retracted by the projection portions 34 toward the outside of the main body 1. In addition, when the tray 5 pushes in from the state illustrated in FIG. 7B to the state illustrated in FIG. 7A, the projection portions 34 enter into the groove portions 35. If the user further pushes in the tray 5, through the engagement of the projection portions 34 of the tray 5 and the groove portions 35 of the support member 7, the support member 7 is pushed in toward the push-in direction Y. In this case, the support member 7 is regulated, through the engagement of the projection portions 31 and the groove portions 32, so as to be movable only in a direction opposite to the direction indicated by arrows Q (FIG. 7A) with respect to the main body 1. For that reason, the support member 7 is moved linearly, with respect to the main body 1, in the direction opposite to the direction indicated by arrows Q (direction toward obliquely downward with respect to push-in direction Y of the tray 5). Further, the support member is regulated, by the projection portions 34 and the groove portions 35, so as to move linearly, with respect to the tray 5, toward the vertical direction and downward only (direction indicated by allows VL of FIG. 3B). With this structure, the light emitting devices 9 are moved linearly toward the drums 12 of the cartridges 8 (direction indicated by arrows VL). The support member 7 moves upstream and downward of the pullout direction X. Therefore, the support member 7 linearly moves from the retracted position RP to the exposure position LP. The exposure position LP locates at an adjacent position to the drum so that the light emitting devices 9 face the drums 12, and are enabled to expose the drum 12 in accordance with an image information. Then, in association with the closing operation of the door 2 performed by the user, the guide 11 is pushed down to left downward from the position illustrated in FIG. 4A via the link 29. The tray 5 moves downward together with the guide 11. With this operation, the cartridges 8 supported by the tray 5 are mounted to the mounting portions 50 in the main body 1. Then, the drum 12 is brought into contact with the transfer belt 18 (FIG. 1A). This state is a state in which the cartridges 8 locate at the image formation positions (FIG. 1A). The image formation positions are positions at which the cartridges 8 contribute to form an image on the sheet (recording medium) 14.

As described above, according to Embodiment 1 of the present invention, the interlocking member 130 includes the projection portions 34 provided to the tray 5, the groove portions 35 provided to the support member 7, the projection portions 31 provided to the support member 7, and the groove portions 32 provided to the main body 1. the interlocking member 130 may automatically moves, in association with the pull out operation of the tray 5 from the main body 1, the support member 7 to the retracted position RP in the main body 1. As described above, the projection portions 34 are provided to the tray 5. The groove portions 35 are provided to the support member 7 so as to move the support member 7 with respect to the tray 5, and engage with the projection portions 34. The projection portions 31 are provided to the support member 7. Further, the groove portions 32 are provided to the main body 1 so as to move the support member 7 with respect to the main body 1, and engage the projection portions 31. Further, the support member 7 moves, in association with the movement of the tray 5 to the outside position OP, linearly moves in a vertical direction and upward with respect to the tray 5 through the engagement of the projection portions 34 and the groove portions 35 included in the interlocking member 130. In addition, the support member 7 moves, through the engagement of the projection portions 31 and the groove portions 32 included in the interlocking member 130, linearly in an oblique direction and downward with respect to the main body 1. With this, the support member 7 moves automatically, in association with the movement of the tray 5, from the exposure position LP to the retracted position RP. Further, in association with the movement of the tray 5 to the inside position IP, the support member 7 linearly moves, through the engagement of the projection portions 34 and the groove portions 35 included in the interlocking member 130, toward the tray 5 in a vertical direction and downward. In addition, the support member 7 linearly moves, through the engagement of the projection portions 31 and the groove portions 32 included in the interlocking member 130, with respect to the main body 1 in an oblique and downward direction. With this, the support member 7 automatically moves from the retracted position RP to the exposure position LP. With this, the cartridges 8 may be replaced by only pullout operation of the tray 5. Thus, according to Embodiment 1 of the present invention, enhancement of usability may be realized. Further, when the tray 5 is pulled out from the main body 1, the support member 7 does not come out outside the main body 1. Thus, the light emitting devices 9 (light emitting portions 6) may be restrained from adhering dust, and being marked. As a result, the reliability of the image forming apparatus can be enhanced.

(Supporting Method for Light Emitting Device)

Figure 9A:
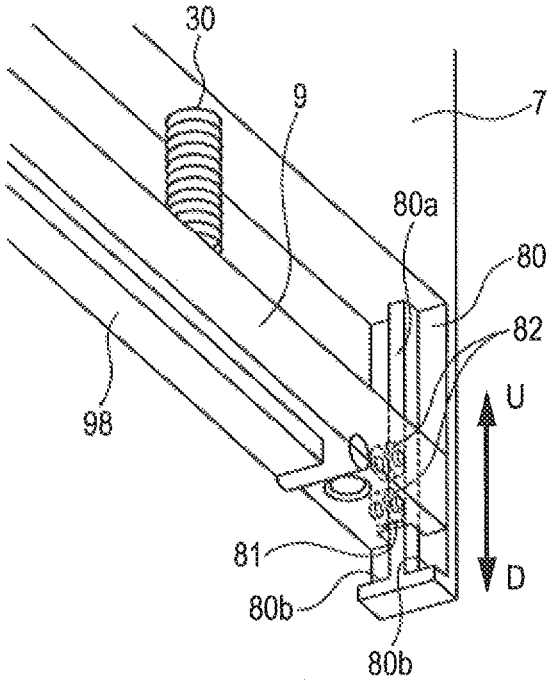
FIG. 9A is a perspective view illustrating a supporting method for the light emitting device by the support member.

FIG. 9A is a perspective view illustrating a supporting method for the light emitting device 9. The support member 7 includes a light emitting device guide (guide member) 80, and supports the light emitting device 9 in an arrow U and an arrow D directions so as to allow a slide movement. The direction of the arrow D is such a direction that the light emitting device 9 approaches with respect to the drum 12. The direction of the arrow U is such a direction that the light emitting device 9 is separated from the drum 12. In other words, the directions of the arrow D and the arrow U are such directions that the light emitting devices 9 moves between the above-mentioned exposure position LP (FIG. 1A and FIG. 10A) and a below-mentioned separated position LD (FIG. 13A) at which the light emitting device 9 is separated from the drum 12. The guides 80 are disposed at one end side and another end side in the longitudinal direction of the light emitting device 9. The movements of the light emitting device 9 toward the approaching direction D and the separating direction U with respect to the drum 12 are supported through the engagements between the groove portion 81 provided to the light emitting device 9 with projection portions 80*a* provided to the guide 80. The projection portion 80*a* and the groove portion 81 constitute the engagement portions between the guide 80 and the light emitting device 9. In addition, in the groove portion 81 of the light emitting device 9, rotatable roller members 82 are provided. The roller members 82 are friction reduction members provided to the engagement portion 80*a* between the guide 80 and the light emitting device 9, and the groove portions 81. The roller members 82 are provided on one end side and another end side in the longitudinal direction of the light emitting device 9. When the light emitting device 9 moves, a part of the projection portion 80*a* of the guide 80 is brought into contact with the roller members 82, thereby allowing the rotation of the roller members 82. With this operation, the friction between the projection portion 80*a* and the groove portion 81 is reduced. With this, the light emitting device 9 smoothly moves, under a substantially horizontal state with respect to the longitudinal direction of the drum 12, toward the approaching direction D and the separating direction U with respect to the drum 12. In addition, the projection portion 80*a* and the groove portion 81 are engaged with an appropriate looseness, thereby being free from inhibiting the positioning of the light emitting device 9 with respect to the drum 12. In addition, the guide 80 is provided with a regulating portion 80*b*. The light emitting device 9 is urged toward the drum 12 by the compression spring 30. However, when the cartridge 8 is not mounted into the main body 1, the movement of the light emitting device 9 approaching toward the drum 12 is regulated by the receiving portions (stopper portions) 80*b* formed at the lower ends of the guide 80.

(Positioning Member)

Figure 9B:
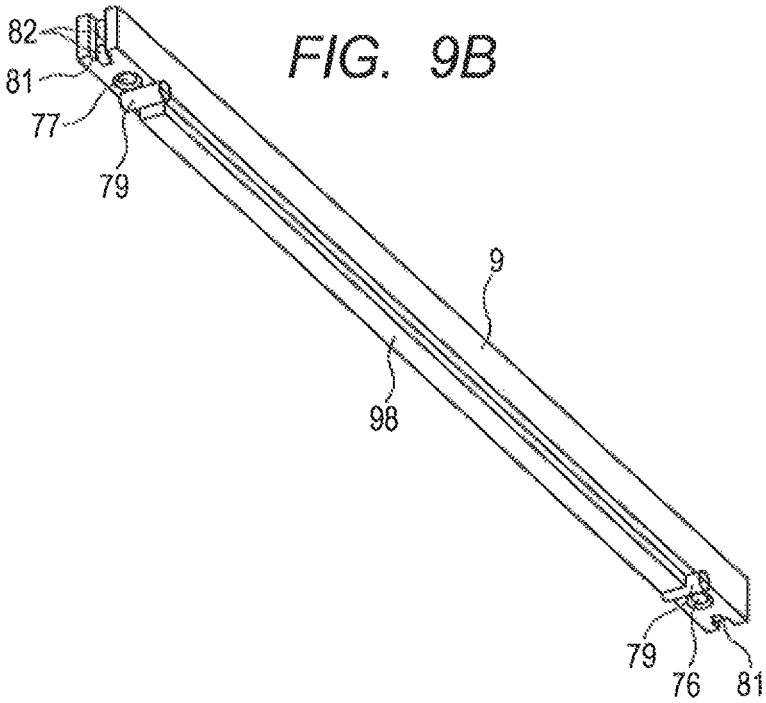
FIG. 9B is a perspective view of the light emitting device.

FIG. 9B is a perspective view of the light emitting device 9. Provided to the light emitting device 9 are, a light emitting device round hole (first regulating portion; front-back and longitudinal regulating portion) 76 as a positioning member and a light emitting device long round hole (second regulating portion; rotation regulating portion) 77. The round hole 76 is formed at one end side in the longitudinal direction of the cartridge 8, that is, a right side viewed from a front surface of the main body 1 in this embodiment. The long round hole 77 is formed in the longitudinal direction of the cartridge 8 and the other end with respect to the round hole 76, that is, a left side viewed from the front surface of the main body 1 in this embodiment. The long round hole 77 is formed so as to be longer in the longitudinal direction. The round hole 76 and the long round hole 77 perform, within an allowable limit error, the positioning of the light emitting device 9 with respect to the cartridge 8 mounted to an image formation position. Note that, the image formation position refers to a position at which the cartridge 8 supported by the tray 5 is mounted to a mounting portion 50 in the main body 1, and the drum 12 is brought into contact with a transfer belt 18. The round hole 76 and the long round hole 77 perform the positioning of the light emitting device 9 with respect to the cartridge 8, when the support member 7 locates at the exposure position in a state in which the cartridge 8 is mounted to the mounting portion 50.

Figure 10A:
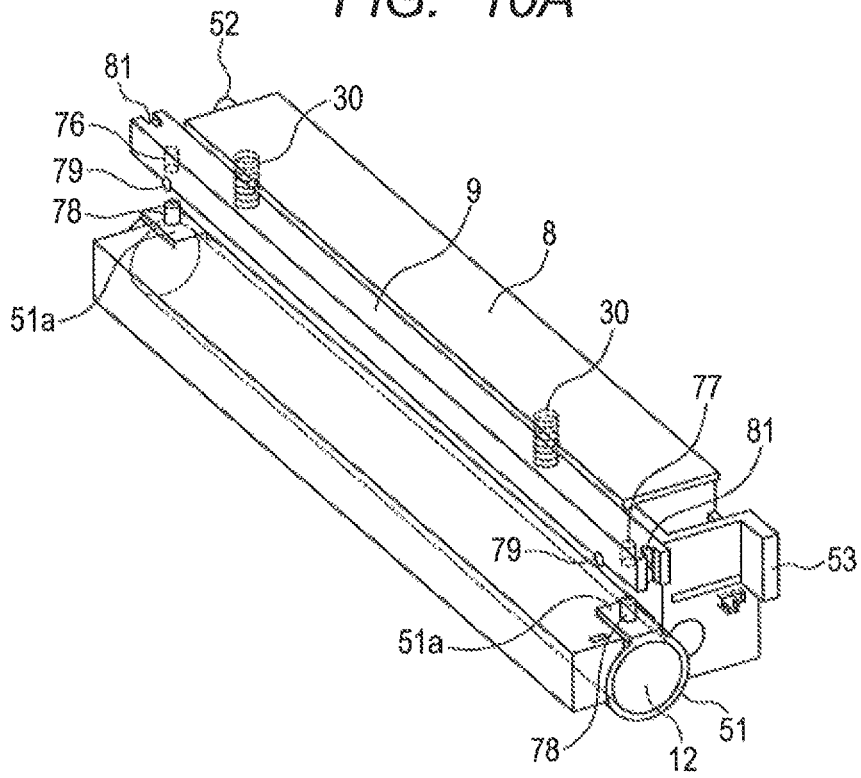
FIG. 10A is a perspective view illustrating a method of positioning the drum of the cartridge with respect to the light emitting devices.

FIG. 10A is a perspective view for illustrating a method of positioning the drum 12 of the cartridge 8 with respect to the light emitting device 9. Drum bosses 78 are respectively provided at each end of the drum 12 in the longitudinal direction of the cartridge 8 at each of the positions corresponding to the round hole 76 and the long round hole 77. The positioning of the light emitting device 9 with respect to an orthogonal direction (front-back direction) to the axis direction of the drums 12 (longitudinal direction) is achieved by respectively inserting the round hole 76 and the long round hole 77 as the positioning portions on the light emitting portion side into each the drum bosses 78 as the positioning portions on the drum side. With this structure, the positioning of the light emitting device 9 with respect to the drum 12 is performed in a front-back direction and the longitudinal direction (right-left direction).

Figure 10B:
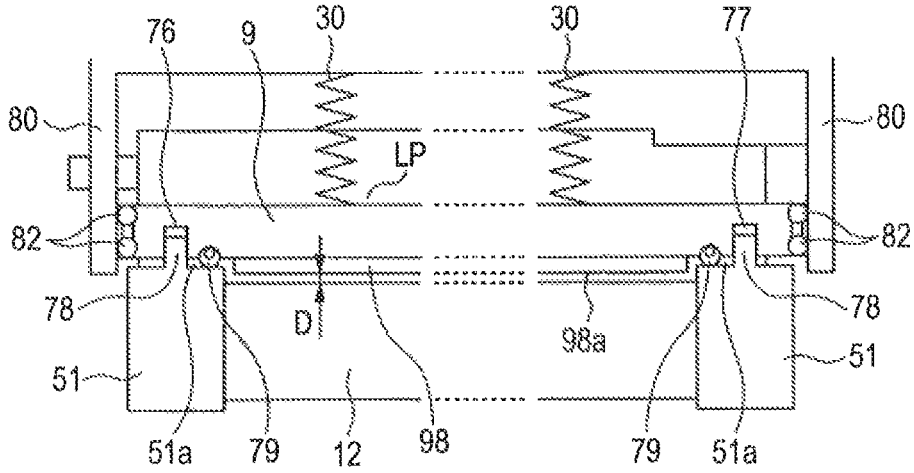
FIG. 10B is a diagram illustrating a state in which the light emitting device is positioned to the cartridge.

Further, the positioning of the light emitting device 9 with respect to the vertical direction of the drum 12 is carried out such that the eccentric cams (luminance device side positioning portions) 79 are supported by the bearing portions (drum side positioning portions) 51. FIG. 10B illustrates a state in which the light emitting device 9 is positioned to the cartridge 8. The eccentric cams 79 each are provided on one end side and the other end side in the longitudinal direction of the light emitting devices 9 at the corresponding positions. The distance between the surface of the drum 12 and the lens surface 98 of the light emitting device 9 is maintained to the predetermined distance through the contact of the circumferential surfaces of the eccentric cams 79 and the receiving surfaces 51*a* of the bearing portions 51. The respective distances corresponding to the four cartridges 8 are adjusted to respective predetermined distances by rotating the eccentric cams 79. The eccentric cams 79 are fixed by an adhesive after adjustment of the distance D.

Besides, urging of the light emitting device 9 toward the drum 12 is carried out such that the light emitting devices 9 is urged by a compression spring (elastic member) 30. As illustrated in FIG. 10A, the springs 30 each are provided on one end side and the other end side in the longitudinal direction of the light emitting device 9 at the corresponding positions. The springs 30 urge the light emitting device 9 toward the exposure position. With this urging force, the positioning of the light emitting devices 9 with respect to the photosensitive drum 12 in an up-down direction (vertical direction) is regulated. The light emitting device 9 is adjacently disposed so as to face the drum 12 at the exposure position. The distance D between the surface of the drum 12 and the surface 98*a* of the SELFOC (Registered Trademark) lens 98 of the light emitting device 9 is regulated to a predetermined distance at the exposure position. The predetermined distance is a distance, which is suited to the exposure of the drum 12. In this embodiment, the predetermined distance falls within a range of 2 mm or more and 3 mm or less. According to this embodiment, if the distance falls within the above-mentioned numerical values, owing to luminescence of the light emitting portions 6 in accordance with image information, the drum 12 is satisfactory exposed. However, if the specifications of the lens 98 are changed, the above-mentioned predetermined distance is changed because a lens thickness and a focal depth vary. As described above, the distance D between the surface of the drum 12 and the lens surface 98*a* of the light emitting device 9 is maintained to the predetermined distance through the contact of the circumferential surface of the eccentric cam and the receiving surfaces 51*a* of the drum bearing portions 51 (FIG. 10B).

(Description of Separating Method for Luminance Device while Packing Cartridge Together)

Next, referring to FIG. 11A to FIG. 13A, description is made of means for separating the light emitting device 9 when the apparatus 100 is shipped while the cartridge 8 is packed together in the main body 1.

(Cartridge Under Packed State)

Figure 12A:
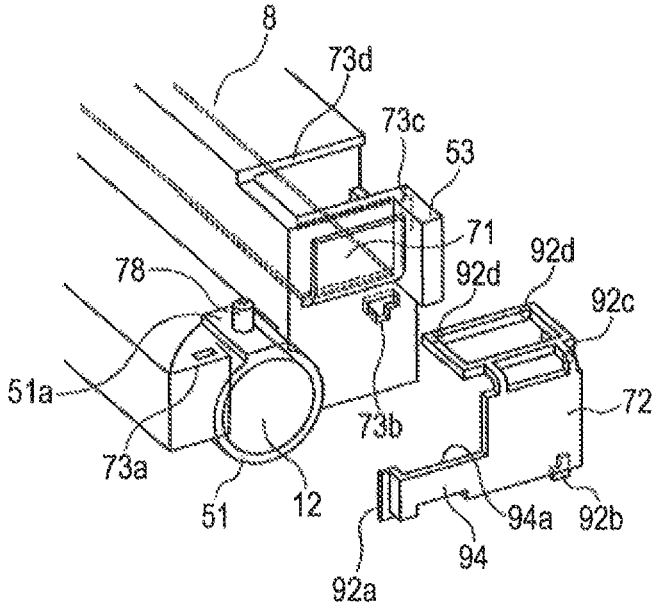
FIGS. 12A and 12B are illustrations of a separating member.

The apparatus 100 according to Embodiment 1 of the present invention is shipped while the cartridges 8 are packed together in the main body 1. FIG. 11A is a sectional view of the cartridge 8 when being shipped while being packed together in the main body 1. When the cartridge 8 of the apparatus 100 according to Embodiment 1 of the present invention is shipped while being packed together in the main body 1, a developer supply port 89 for supplying a toner from a toner receiving chamber (developer containing part) 89A of a developing device to a developer chamber 32B is sealed with a developer seal 71. The developer seal 71 is disposed at the developer supply port within the cartridge 8. In this embodiment, the developer seal 71 serves as a regulating member for regulating the supply of a toner T from the toner receiving chamber 32A to the developer chamber 32B, while the cartridges 8 are packed together in the main body. The developer seal 71 regulates the supply of the developer from the developer supply port 32 when the cartridge 8 is shipped while being packed together in the main body 1. Besides, FIG. 11B is a perspective view of the cartridge 8 when being shipped while being packed together in the main body 1. The developer seal 71 is provided with a pull-tab 72, which serves as a holding part of a user when the user removes the developer seal 71 from the cartridge 8. The pull-tab 72 is provided on one end side in a longitudinal direction of the cartridge 8, that is, a left side of the main body 1 viewed from the front surface side in this embodiment. Further, the pull-tab 72 is provided with engagement portions 92*a*, 92*b*, 92*c* and 92*d* each of which serves as an installation portion to the cartridge 8. The cartridge 8 is provided with to-be engaged portions 73*a*, 73*b*, 73*c* and 73*d* at the corresponding positions of the engagement portions 92*a*, 92*b*, 93*c* and 93*d* of the pull-tab 72. FIG. 12A illustrates a positional relationship between the engagement portions 92*a*, 92*b*, 92*c* and 92*d* of the pull-tab 72 and the to-be engaged portions 73*a*, 73*b*, 73*c* and 73*d* of the cartridge 8. The engagement portion 92*a* provided to the pull-tab 72 engages with a to-be engaged portion 73*a* of the cartridge 8. The engagement portion 92*b* provided to the pull-tab 72 engages with a to-be engaged portion 73*b* of the cartridge 8. The engagement portion 92*c* provided to the pull-tab 72 engages with the to-be engaged portion 73*c* of the cartridge 8. The engagement portion 92*d* provided to the pull-tab 72 engages with a to-be engaged portion 73*d* of the cartridge 8. The pull-tab 72 is fixed to the cartridge 8 through the engagement of the engagement portions 92*a*, 92*b*, 93*c* and 93*d* and the to-be engaged portions 73*a*, 73*b*, 73*c* and 73*d* of the cartridge 8. In FIG. 12A, the developer seal 71 and the pull-tab 72 are illustrated dividedly for explanation, but the pull-tab 72 is fixed to the developer seal 71 by an adhesive, or the like to be mounted to the cartridge 8. In addition, as illustrated in FIG. 11B, the pull-tab 72 is provided a support member 94. The support member 94 supports the light emitting device 9 to a separated position LD (FIG. 13A) separating from the drum 12 by the separating member described later.

(Installation Method for Cartridge Under Packed State)

The cartridge 8 under a packed state is mounted to the main body 1 in a similar manner when the user mounts the cartridge at the time of image formation. Specifically, a worker who conducts the mounting operation pulls out the tray 5 to the outside position OP, and mounts (cause to support) the cartridge 8 under a packed state on the tray 5. The tray 5 having mounted thereon the cartridge 8 is pushed into the main body 1. At this time, the support member 7 automatically starts moving from the retracted position RP to the exposure position LP by the above-mentioned interlocking member 130 in association with the movement of the tray 5 when the user pushes in the tray 5. Then, as the cartridge 8 under a packed state is provided with the separating member described later, the light emitting device 9 is supported to the separated position LD. Here, at the separated position LD, the gap between the circumference surface of the eccentric cams 79 and the receiving surface 51*a* of the drum bearing portions 51 is separated so as not to be brought into contact with each other when a mechanical shock is applied to the apparatus 100 during transportation. In addition, at the separated position, the gap between the surface of the drum 12 and the lens surface 98*a* of the light emitting devices 9 is separated at a distance so as not to be brought into contact with each other when a mechanical shock is applied to the image forming apparatus 100 during the transportation. Then, in association with closing operation of the door 2 by the worker, the cartridge 8 is mounted to the mounting portion 50 in the main body 1. Then, the drum 12 is brought into contact with a transfer belt 18. At this time, the light emitting device 9 is continuously supported at the separated position. Then, under this state, the apparatus 100 is wrapped and shipped to a user.

(Structure of Separating Member)

Figure 12B:
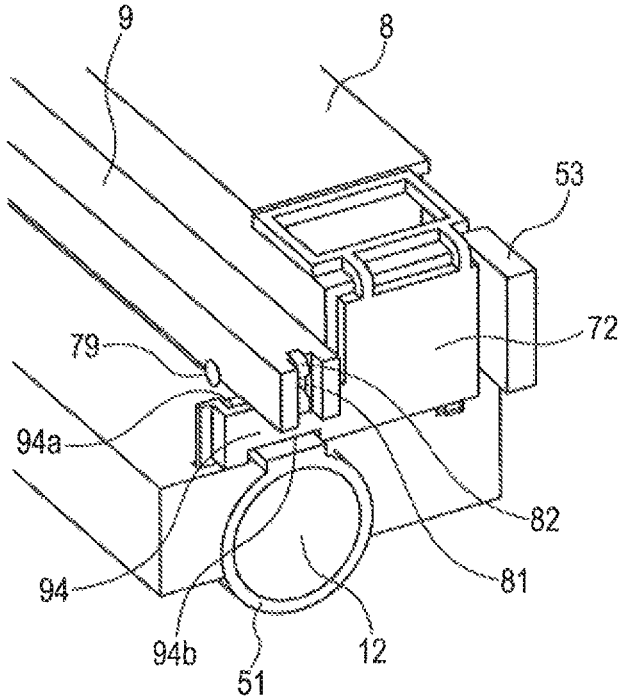

The apparatus 100 according to Embodiment 1 of the present invention includes separating members for supporting the light emitting devices 9 to the separated positions separating from the drum 12 in a state in which the cartridges 8 are shipped while being packed together in the main body 1. Now, the separating member is described. FIG. 12B illustrates a positional relationship between the light emitting devices 9 and the cartridge 8 at the above-mentioned separated position LD. The separating member is provided with the support member 94. As described above, the support member 36 is provided to the pull-tab 72. The pull-tab 72 is provided on one end side in the longitudinal direction of the cartridge 8, that is, a left side of the main body 1 viewed from the front surface in this embodiment. In other words, the support member 94 is provided only on one end side in the longitudinal direction. The support member 94 is arranged between the light emitting device 9 and the drum bearing portion 51. The separating of the light emitting device 9 to the separated position LD is carried out through the support of the light emitting device 9 by the support member 94. As illustrated in FIG. 12B, when the light emitting device 9 is positioned at the separated position LD, the light emitting device 9 is urged toward the exposure position by the spring 30, that is, downward of the main body in this embodiment. The light emitting device 9 is supported to the separated position LD by an upper surface 94*a* of the support member 94. The support of the support member 94 is carried out through the contact between a lower surface 94*b* of the support member 94 and the drum bearing portions 51.

Figure 13A:
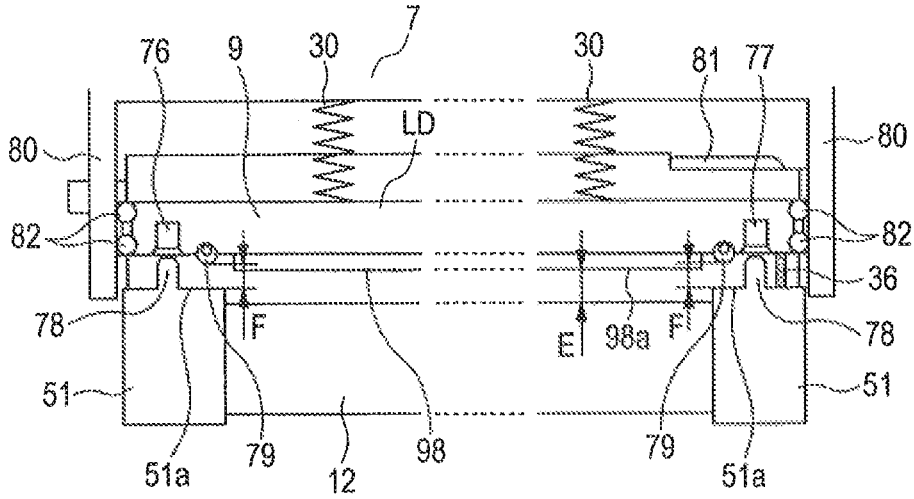
FIG. 13A is an illustration of the separating member.

FIG. 13A is a vertical sectional view in which midway portions are omitted, for illustrating the light emitting device 9 and the cartridge 8 viewed from the front surface of the main body 1 when the cartridge 8 is shipped while being packed together in the main body 1. The light emitting devices 9, which is urged toward the exposure position by the spring 30, is supported on one end side in the longitudinal direction of the cartridge 8 to the above-mentioned separated position LD by the support member 94. At this time, the light emitting device 9 is supported by the guide 80 provided to the support member 7 (FIG. 9A). As described above, the light emitting device 9 smoothly moves, under a substantially horizontal state with respect to the longitudinal direction of the drum 12, toward the approaching direction and the separating direction with respect to the drum 12. With this, as one end side is separated from the support member 94, and another end side (side at which support member 94 is not provided) of the light emitting devices 9 is also supported in a substantially horizontal state, thereby being supported to the separated position LD. Then, as illustrated in FIG. 13A, there is provided a gap E between the surface of the drum 12 and the lens surface 98*a* of the light emitting devices 9. The gap E is larger than a gap D when the light emitting device 9 is positioned at the exposure position LP (FIG. 10A). In addition, there is similarly provided a gap F between the circumferential surface of the eccentric cams and the receiving surface 51 of the drum bearing portions 51. With this, the surface of the drum 12 and the lens surface 98*a* of the light emitting devices 9 may be prevented from being brought into contact with each other when a mechanical shock is applied to the apparatus 100 during the transportation. Further, the circumferential surface of the eccentric cams 79 and the receiving surface 51 of the drum bearing portions 51 may be prevented from being brought into contact with each other when a mechanical shock is applied to the apparatus 100 during the transportation.

(Releasing Method for Separating Member)

Further, at the time of image formation, the cartridge 8 is mounted in a state in which the developer seal 71 is removed by a user. Then, the pull-tab 72 is removed from the cartridge 8 when the user removes the developer seal 71 from the cartridge 8. With this, the light emitting devices 9 starts to be supported to the above-mentioned exposure position LP (FIG. 1A, FIG. 10B). Besides, the developer within the cartridge 8 starts to be supplied from the developer supply port 32. Specifically, in association with releasing operation of the developer seal 71 as the regulating member, the support member 94 as the separating member, which is provided to the pull-tab 72, is released, and hence the light emitting device 9 moves from the separated position LD to the exposure position LP.

As described above, according to Embodiment 1 of the present invention, the separating member includes the support member 94 provided to the pull-tab 72. The support member 94 may support the light emitting device 9, which is to be urged by the spring 30 when the cartridge 8 is shipped while being packed together in the main body 1, to the separated position LD (FIG. 13A). Further, the light emitting device 9 smoothly moves by the aid of the guide 80 provided to the support member 7, under a substantially horizontal state with respect to the longitudinal direction of the drum 12, toward the approaching direction and the separating direction with respect to the drum 12. With this, through the support by only one end side in the longitudinal direction of the light emitting device 9 by the support member 94, another end side of the light emitting device 9 may be supported to the separated position LD. With this, the circumferential surface of the eccentric cams 79 and the receiving surface 51*a* of the drum bearing portions 51 may be prevented from being brought into contact with each other when a mechanical shock is applied to the apparatus 100 during the transportation. The circumferential surface of the eccentric cams 79 and the receiving surface 51*a* of the drum bearing portions 51 are members for determining a distance between the surface of the drum 12 and the lens surface 98*a* of the light emitting device 9. In addition, the surface of the drum 12 and the lens surface 98*a* of the light emitting device 9 may be prevented from being brought into contact with each other when a mechanical shock is applied to the apparatus 100 during the transportation. Therefore, according to Embodiment 1 of the present invention, the reliability during the transportation while packing the cartridge together may be enhanced.

Embodiment 2

Figure 13B:
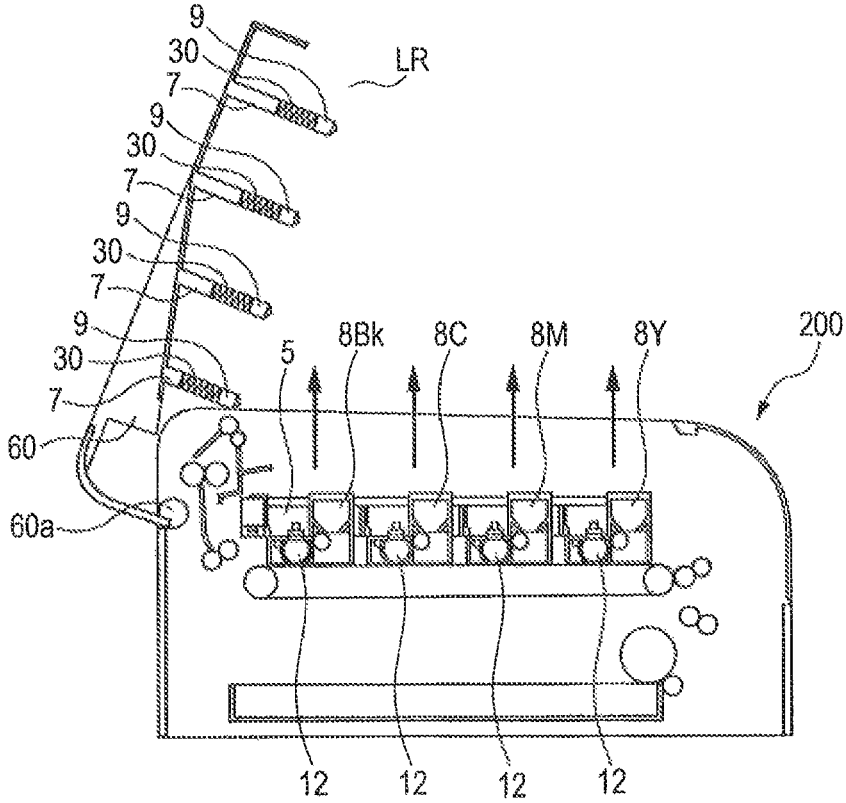
FIG. 13B is an illustration of an image forming apparatus according to a second embodiment.
Figure 14A:
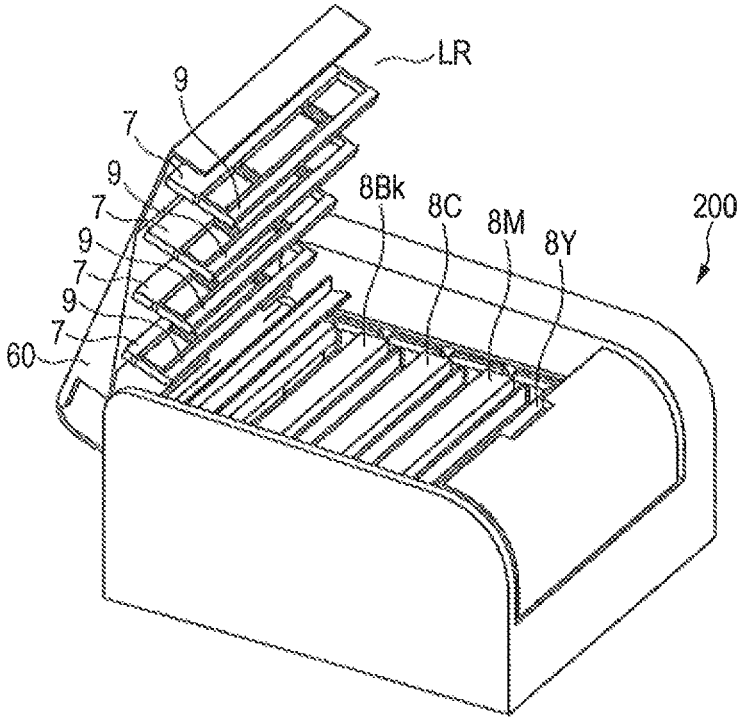
FIGS. 14A and 14B are illustrations each illustrate the image forming apparatus.
Figure 14B:
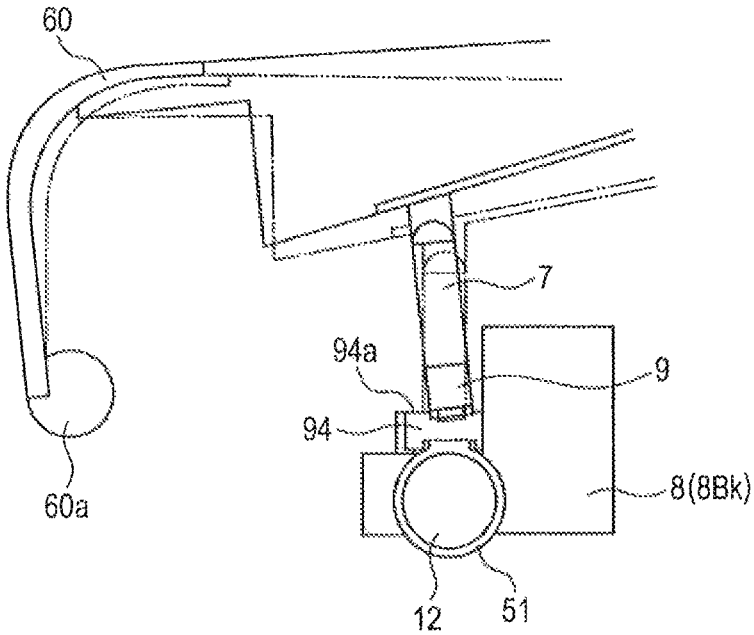

Description is made of an image forming apparatus 200 according to Embodiment 2 of the present invention with reference to FIG. 13B and FIGS. 14A and 14B. The same structure with Embodiment 1 of the present invention is denoted by the same reference numeral, and the description thereof is omitted. In the apparatus 200, an openable and closable member 60 provided on a top surface side of the main body 1 is released, thereby being capable of replacing the cartridge 8. FIG. 13B is a vertical sectional right side view of the apparatus 200 when the openable and closable member 60 is released. Further, FIG. 14A is a perspective view of the apparatus 200 when the openable and closable member 60 is released. The openable and closable member 60 is rotated with respect to the main body 1 so as to be openable and closable by the user about a hinge portion 60*a* as a center. The support member 7 moves from the exposure position LP to the retracted position LR together with the openable and closable member 60 by rotating, by the user, the openable and closable member 60 so as to be opened. The support member 7 moves to the retracted position LR, and hence the multiple light emitting devices 9 may be retracted at the same time. With this, the upward of all the cartridges 8 supported by the tray 5 are released. Then, the respective cartridges 8 may be removed upward thereof (arrow direction in FIG. 13B). In addition, all the cartridges 8 may be supported from the upward to the tray 5. Specifically, the mounting and removing of the cartridges 8 with respect to the tray 5 may be carried out from the vertical direction.

Further, the apparatus 200 according to Embodiment 2 of the present invention may be shipped while packing the cartridges 8 together in the main body 1 as in Embodiment 1 of the present invention. The cartridge 8 of the apparatus 200 includes, as in Embodiment 1 of the present invention, the developer seal 71 provided with the pull-tab 72 (FIG. 11B) when being shipped while being packed together in the main body 1. The pull-tab 72 is provided on one end side in the longitudinal direction of the cartridge 8, that is, a left side of the main body 1 viewed from the front surface in this embodiment. The pull-tab 72 is provided with the support member 94. The support member 94 supports, as in Embodiment 1 of the present invention, the light emitting device 9 to the separated position LD which is separated from the drum 12 (FIG. 12B, FIG. 13A).

In the image forming apparatus 200 according to Embodiment 2 of the present invention, the cartridge 8 under a packed state is mounted to the main body 1 in a similar manner when the user mounts the cartridge at the time of image formation. Specifically, a worker who conducts the mounting operation releases the openable and closable member 60 and mounts the cartridge 8 under a packed state on the tray 5. Subsequently, the worker closes the openable and closable member 6, and hence the light emitting device 9 starts moving from the retracted position LR to the exposure position LP. As the support member 94 is provided on one end side in the longitudinal direction of the cartridge 8 under a packed state, the light emitting device 9 is supported to the separated position LD. FIG. 14B illustrates a positional relationship when the light emitting device 9 of the apparatus 200 is brought into contact with the support member 94. The light emitting device 9 of the apparatus 200 is brought into contact with the support member 94 while being slant with respect to the up-down direction of the drum (vertical direction). At this time, the light emitting device 9 of the apparatus 200 is also brought into contact with the top surface 94*a* of the support member 94 while being slant. The light emitting device 9 of the apparatus 200 is, as in Embodiment 1 of the present invention, supported by the guide 80 provided to the support member 7 (FIG. 9A). In this case, the light emitting device 9 is supported along the shape of the projection 80*a* provided to the guide 80 so as to be movable in arrows U and D directions of FIG. 9A. With this structure, even when the light emitting device 9 is brought into contact with the support member 94 while being slant, the light emitting device 9 smoothly moves to the separated position LD of the light emitting device 9. Further, the light emitting device 9 of the apparatus 200 smoothly moves, as in Embodiment 1 of the present invention, by the guide 80, under a substantially horizontal state with respect to the longitudinal direction of the drum 12, toward the approaching direction and the separating direction with respect to the drum 12. With this, in the light emitting device 9, when one end side is separated by the support member 94, another end side (side at which support member is not provided) is also supported to the separated position LD.

As described above, according to Embodiment 2 of the present invention, when the cartridge 8 is shipped while being packed together in the main body 1, the light emitting device 9 to be urged by the spring 30 may be supported to the separated position LD (FIG. 13A). With this, the circumferential surface of the eccentric cams 79 and the receiving surface 51*a* of the drum bearing portions 51 may be prevented from being brought into contact with each other when a mechanical shock is applied to the image forming apparatus 100 during the transportation. In addition, the surface of the drum 12 and the lens surface 98*a* of the light emitting device 9 may be prevented from being brought into contact with each other when a mechanical shock is applied to the image forming apparatus 100 during the transportation. Therefore, according to Embodiment 2 of the present invention, the reliability during the transportation while packing the cartridge together may be enhanced.

Other Embodiments

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-126814, filed on Jun. 2, 2010, which is hereby incorporated by reference herein in its entirety.

What is claimed is:

1. An image forming apparatus that forms an image on a recording medium in a state in which a cartridge, including a photosensitive member, is removably mounted to a main body of the apparatus, the image forming apparatus comprising:

a light emitting device that includes multiple light emitting portions, provided in a rotation axis direction of the photosensitive member, that illuminate in association with image information, the light emitting device being movable between (i) an exposure position for exposing the photosensitive member to illumination by the multiple light emitting portions and (ii) a retracted position retracted away from the photosensitive member relative to the exposure position;

a support member that supports the light emitting device, wherein the light emitting device is movable by movement of the support member, the support member being movable between (i) a first position that allows for positioning the light emitting device at the exposure position and (ii) a second position that positions the light emitting device at the retracted position; and a separating member separating the light emitting device from the photosensitive member, wherein, in a state where the cartridge is mounted to the main body of the apparatus and the support member is positioned at the first position, the separating member regulates the light emitting device from moving to the exposure position by separating the light emitting device from the photosensitive member.

2. An image forming apparatus according to claim 1, wherein the separating member is detachable from the cartridge, and wherein, in a state where the cartridge from which the separating member is detached is mounted to the main body of the apparatus, the light emitting device is movable to the exposure position.

3. An image forming apparatus according to claim 1, further comprising an elastic member provided between the light emitting device and the support member, wherein in a case where the support member is positioned at the first position, the elastic member presses the light emitting device against the photosensitive member.

4. An image forming apparatus according to claim 3, wherein, when the support member is positioned at the first position and the light emitting device is positioned at the exposure position, the light emitting device pressed by the elastic member against the photosensitive member contacts a positioning portion of the cartridge so that the light emitting device is positioned at the exposure position.

5. An image forming apparatus according to claim 3, wherein the separating member prevents the light emitting device from moving to the exposure position by being sandwiched between the light emitting device and the cartridge.

6. An image forming apparatus according to claim 1, further comprising an openable and closable member that is openable and closable with regard to the main body of the apparatus, wherein the support member is positioned at the second position in a state where the openable and closable member is opened with regard to the main body of the apparatus, and the support member is positioned at the first position in a state where the openable and closable member is closed.

7. An image forming apparatus according to claim 5, wherein, when the support member is positioned at the first position, the separating member supports the light emitting device to separate the light emitting device from the photosensitive member, and wherein a portion of the light emitting device supported by the separating member is different from a portion of the light emitting device contacting a positioning portion of the cartridge.

8. An image forming apparatus according to claim 5, wherein, when the support member is positioned at the first position, the separating member supports the light emitting device to separate the light emitting device from the photosensitive member, and wherein a portion of the cartridge at which the separating member supporting the light emitting device contacts is different from a positioning portion of the cartridge.

* * * * *